US010764665B2

(12) United States Patent
Nagai et al.

(10) Patent No.: US 10,764,665 B2
(45) Date of Patent: Sep. 1, 2020

(54) MICROPHONE AND SOUND PICKUP METHOD

(71) Applicant: JVC KENWOOD Corporation, Yokohama-shi, Kanagawa (JP)

(72) Inventors: Toshiaki Nagai, Yokohama (JP); Hiroshi Uchida, Yokohama (JP); Kenji Ejima, Yokohama (JP); Hisako Murata, Yokohama (JP); Masaya Konishi, Yokohama (JP)

(73) Assignee: JVCKENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 16/373,363

(22) Filed: Apr. 2, 2019

(65) Prior Publication Data

US 2019/0306604 A1 Oct. 3, 2019

(30) Foreign Application Priority Data

Apr. 2, 2018 (JP) ..... 2018-070523

(51) Int. Cl.
*H04R 1/08* (2006.01)
*H04R 29/00* (2006.01)

(52) U.S. Cl.
CPC ..... *H04R 1/083* (2013.01); *H04R 29/001* (2013.01)

(58) Field of Classification Search
CPC .... H04R 5/033; H04R 1/1041; H04R 1/1016; H04R 1/1058; H04R 1/1075; H04R 1/02; H04R 1/1008; H04R 1/1066; H04R 2410/05; H04R 1/1033; H04R 19/04; H04R 1/083; H04R 1/406; H04R 1/08; H04R 2201/107; H04R 29/001; G10K 2210/1081
USPC ..... 381/303–305, 309, 26, 91, 56, 122, 355, 381/370–375, 71.6
See application file for complete search history.

(56) References Cited

U.S. PATENT DOCUMENTS

2007/0154046 A1* 7/2007 Mishan ..... H04R 1/1083 381/370
2009/0245529 A1* 10/2009 Asada ..... G10K 11/17881 381/71.6

FOREIGN PATENT DOCUMENTS

JP 2015-126267 A 7/2015
JP 2015126267 * 7/2015

* cited by examiner

*Primary Examiner* — Norman Yu
(74) *Attorney, Agent, or Firm* — Procopio, Cory, Hargreaves & Savitch LLP

(57) ABSTRACT

A microphone according to an embodiment includes: an ear chip including a cylindrical part with a hollow part formed therein, and a contact part disposed outside the cylindrical part and configured to come into contact with an inner wall surface of an ear canal; a cable lead out to a gap between the cylindrical part and the contact part; and a microphone element disposed in the hollow part and connected to the cable.

9 Claims, 31 Drawing Sheets

ZY-CROSS SECTION

XY-PLANE VIEW

ZY-CROSS SECTION

XY-PLANE VIEW

MICROPHONE AND SOUND PICKUP METHOD

CROSS REFERENCE TO RELATED APPLICATION

This application is based upon and claims the benefit of priority from Japanese patent application No. 2018-70523, filed on Apr. 2, 2018, the disclosure of which is incorporated herein in its entirety by reference.

BACKGROUND

The present disclosure relates to a microphone and a sound pickup method.

Sound localization techniques include, for example, an out-of-head localization technique, which localizes sound images outside the head of a listener by using headphones. The out-of-head localization technique localizes sound images outside the head by canceling characteristics from the headphones to the ears and giving four characteristics (spatial acoustic transfer characteristics) from stereo speakers to the ears.

In out-of-head localization reproduction, measurement signals (impulse sounds etc.) that are output from 2-channel (which is referred to hereinafter as "ch") speakers are recorded by microphones (which can be also called "mike") placed on the listener's ears. Then, a processing unit generates a filter based on sound pickup signals obtained by impulse responses. The generated filter is convolved to 2-ch audio signals, thereby implementing out-of-head localization reproduction.

Further, in order to generate a filter for cancelling characteristics from the headphones to the ears, characteristics from the headphones to the ears or eardrums (which are also referred to as an "ear-canal transfer function ECTF" or "ear-canal transfer characteristics") are measured by using microphones placed in the listener's ears.

Japanese Unexamined Patent Application Publication No. 2015-126267 discloses earphones/microphones that can be worn on user's ears. Each of the earphones/microphones disclosed in Japanese Unexamined Patent Application Publication No. 2015-126267 includes a housing, a speaker, an ear piece, and a microphone. The housing includes a housing part for storing the speaker and a sound tube part in which the microphone is disposed. The sound tube part of the housing is attached to the ear piece.

In order to perform an out-of-head localization process, it is preferable to measure both of spatial acoustic transfer characteristics and ear-canal transfer characteristics for each individual person. In Japanese Unexamined Patent Application Publication No. 2015-126267, a measurement unit for measuring a head-related transfer function (HRTF), which is spatial acoustic transfer characteristics, and a measurement unit for measuring ear-canal transfer characteristics are separately prepared. That is, two ear pieces having the same shape are prepared. Further, microphones are disposed in their sound tube parts so that the positions of the microphones relative to the ear pieces coincide with each other.

In Japanese Unexamined Patent Application Publication No. 2015-126267, the spatial acoustic transfer characteristics and the ear-canal transfer characteristics are measured by different microphones. Therefore, there is a possibility that the measured characteristics could vary due to the individual differences of the microphones. It is desired that the microphones be placed as close to the ear drums as possible.

SUMMARY

A microphone according to an embodiment includes an ear chip including: a cylindrical part with a hollow part formed therein, a contact part disposed outside the cylindrical part and configured to come into contact with an inner wall surface of an ear canal, and an opening; a cable configured to pass through the opening; and a microphone element disposed in the hollow part and connected to the cable.

According to the present disclosure, it is possible to provide a microphone and a sound pickup method capable of appropriately picking up sounds.

BRIEF DESCRIPTION OF THE DRAWINGS

The above and other aspects, advantages and features will be more apparent from the following description of certain embodiments taken in conjunction with the accompanying drawings, in which.

DETAILED DESCRIPTION

An outline of a sound localization process according to an embodiment is described. An out-of-head localization process according to this embodiment is an out-of-head localization process performed by using spatial acoustic transfer characteristics and ear-canal transfer characteristics. The spatial acoustic transfer characteristics are transfer characteristics from sound sources such as speakers to ear canals. The ear-canal transfer characteristics are transfer characteristics from speaker units of headphones or earphones to eardrums. In this embodiment, the out-of-head localization process is implemented by measuring spatial acoustic transfer characteristics in a state where a user wears neither headphones nor earphones, measuring ear-canal transfer characteristics in a state where the user wears headphones or earphones, and using data of these measurements. One of the features of this embodiment lies in a structure of a microphone and a sound pickup device for measuring spatial acoustic transfer characteristics or ear-canal transfer characteristics (hereinafter collectively referred to as individual characteristics) of a user (a listener) himself/herself.

The out-of-head localization process according to this embodiment is performed by a personal computer, a smartphone, a tablet PC (Personal Computer), a user terminal, etc. The user terminal is an information processing device including processing means such as a processor, storage means such as a memory and a hard disk drive, display means such as a liquid crystal monitor, and input means such as a touch panel, a button, a keyboard, and a mouse. The user terminal may have a communication function of transmitting/receiving data. Further, output means (an output unit) including headphones or earphones is connected to the user terminal.

(Out-of-Head Localization Process Device)

Figure 1:
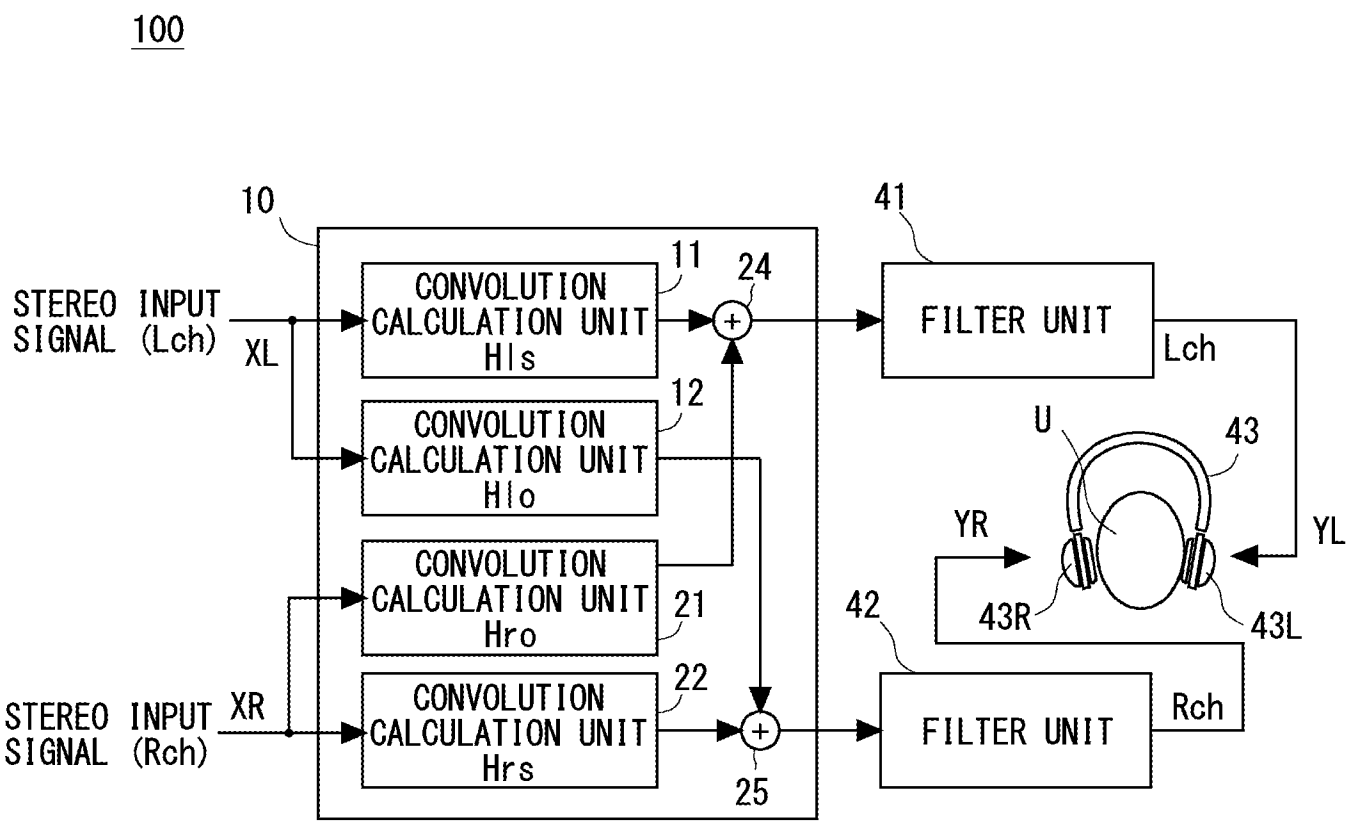
FIG. 1 is a block diagram showing an out-of-head localization process device according to an embodiment.

FIG. 1 shows an out-of-head localization device 100, which is an example of a sound field reproduction device according to this embodiment. FIG. 1 is a block diagram of the out-of-head localization device 100. The out-of-head localization device 100 reproduces sound fields for a user U who is wearing headphones 43. Thus, the out-of-head localization device 100 performs sound localization for L-ch and R-ch stereo input signals XL and XR. The L-ch and R-ch stereo input signals XL and XR are analog audio reproduction signals that are output from a CD (Compact Disc) player or the like, or digital audio data such as mp3 (MPEG Audio Layer-3). Note that audio reproduction signals and digital audio data are collectively referred to as reproduction signals. That is, the L-ch and R-ch stereo input signals XL and XR are reproduction signals.

Note that the out-of-head localization device 100 is not limited to a physically single device, and a part of processing may be performed in a different device. For example, a part of processing may be performed by a personal computer or the like, and the rest of processing may be performed by a DSP (Digital Signal Processor) included in the headphones 43 or the like.

The out-of-head localization device 100 includes an out-of-head localization process unit 10, a filter unit 41, a filter unit 42, and headphones 43. Specifically, the out-of-head localization process unit 10, the filter unit 41, and the filter unit 42 can be implemented by a processor(s) or the like.

The out-of-head localization process unit 10 includes convolution calculation units 11 to 12 and 21 to 22, and adders 24 and 25. The convolution calculation units 11 to 12 and 21 to 22 perform convolution processing using the spatial acoustic transfer characteristics. The stereo input signals XL and XR from a CD player or the like are input to the out-of-head localization process unit 10. The spatial acoustic transfer characteristics are set to the out-of-head localization process unit 10. The out-of-head localization process unit 10 convolves a filter of the spatial acoustic transfer characteristics (hereinafter also referred to as a special acoustic filter) into each of the stereo input signals XL and XR having the respective channels. The spatial acoustic transfer characteristics may be a head-related transfer function (HRTF) measured in the head or auricle of the subject who undergone the measurement (hereinafter referred to as the measurement subject), or may be the head-related transfer function of a dummy head or a third person.

A set of four spatial acoustic transfer characteristics Hls, Hlo, Hro and Hrs is defined as a spatial acoustic transfer function. Data that is used for convolutions in the convolution calculation units 11, 12, 21 and 22 becomes a spatial acoustic filter. The spatial acoustic filter is generated by cutting out the spatial acoustic transfer characteristics Hls, Hlo, Hro and Hrs with a predetermined filter length.

Each of the spatial acoustic transfer characteristics Hls, Hlo, Hro and Hrs is acquired in advance by an impulse response measurement or the like. For example, a user U wears a microphone on each of his/her left and right ears. Each of left and right speakers disposed in front of the user U outputs an impulse sound for performing an impulse response measurement. Then, measurement signals such as the impulse sounds or the like output from speakers are picked up by the microphones. The spatial acoustic transfer characteristics Hls, Hlo, Hro and Hrs are acquired based on the sound pickup signals in the microphones. The spatial acoustic transfer characteristics Hls between the left speaker and the left microphone, the spatial acoustic transfer characteristics Hlo between the left speaker and the right microphone, the spatial acoustic transfer characteristics Hro between the right speaker and the left microphone, and the spatial acoustic transfer characteristics Hrs between the right speaker and the right microphone are measured.

The convolution calculation unit 11 convolves a spatial acoustic filter corresponding to the spatial acoustic transfer characteristics Hls to the L-ch stereo input signal XL. The convolution calculation unit 11 outputs convolution calculation data to the adder 24. The convolution calculation unit 21 convolves a spatial acoustic filter corresponding to the spatial acoustic transfer characteristics Hro to the R-ch stereo input signal XR. The convolution calculation unit 21 outputs convolution calculation data to the adder 24. The adder 24 adds the two convolution calculation data and outputs the data to the filter unit 41.

The convolution calculation unit 12 convolves a spatial acoustic filter corresponding to the spatial acoustic transfer characteristics Hlo to the L-ch stereo input signal XL. The convolution calculation unit 12 outputs convolution calculation data to the adder 25. The convolution calculation unit 22 convolves a spatial acoustic filter corresponding to the spatial acoustic transfer characteristics Hrs to the R-ch stereo input signal XR. The convolution calculation unit 22 outputs convolution calculation data to the adder 25. The adder 25 adds the two convolution calculation data and outputs the data to the filter unit 42.

An inverse filter that cancels the headphone characteristics (characteristics between the reproduction unit of the headphone and the microphone) is set in each of the filter units 41 and 42. Then, the inverse filter is convolved to the reproduced signals (convolution calculation signals) on which processing in the out-of-head localization process unit 10 has been performed. The filter unit 41 convolves the inverse filter of the L-ch side headphone characteristics to the L-ch signal from the adder 24. Likewise, the filter unit 42 convolves the inverse filter of the R-ch side headphone characteristics to the R-ch signal from the adder 25. The inverse filter cancels the characteristics from a headphone unit to microphones when the headphones 43 are worn. The microphone may be placed in anywhere between the entrance of the ear canal and the eardrum. As described later, the inverse filter is calculated from a result of measurement of characteristics of the user U himself/herself.

The filter unit 41 outputs the processed L-ch signal YL to a left unit 43L of the headphones 43. The filter unit 42 outputs the processed R-ch signal YR to a right unit 43R of the headphones 43. The user U is wearing the headphones 43. The headphones 43 output the L-ch signal YL and the R-ch signal YR (hereinafter also collectively referred to as the stereo signals) toward the user U. It is thereby possible to reproduce the acoustic image that is localized outside the head of the user U. Further, a DRC process is performed on the stereo signals YL and YR as described later.

As described above, the out-of-head localization device 100 performs the out-of-head localization process by using the spatial acoustic filter corresponding to the spatial acoustic transfer characteristics Hls, Hlo, Hro and Hrs, and the inverse filter of the headphone characteristics. In the following description, the spatial acoustic filter corresponding to the spatial acoustic transfer characteristics Hls, Hlo, Hro and Hrs and the inverse filter of the headphone characteristics are collectively referred to as out-of-head localization process filters. In the case of 2-channel stereo reproduction signals, the out-of-head localization filters consist of four spatial acoustic filters and two inverse filters. Further, the out-of-head localization device 100 performs the out-of-head localization process by performing a convolution calculation processes by using the six out-of-head localization filters in total for the stereo reproduction signals. The out-of-head localization filter is preferably based on measurements of the individual user U. For example, the out-of-head localization filter is set based on sound pickup signals picked up by the microphones worn on the ears of the user U.

As described above, the spatial acoustic filters and the inverse filter of the headphone characteristics are filters for audio signals. As these filters are convoluted to the reproduction signals (the stereo input signals XL and XR), the out-of-head localization device 100 performs the out-of-head localization process.

Note that in FIG. 1, the out-of-head localization device 100 performs the out-of-head localization process by using the headphones 43. However, in this embodiment, the out-of-head localization device 100 may perform the out-of-head localization process by using earphones.

(Filter Generation Device)

Figure 2:
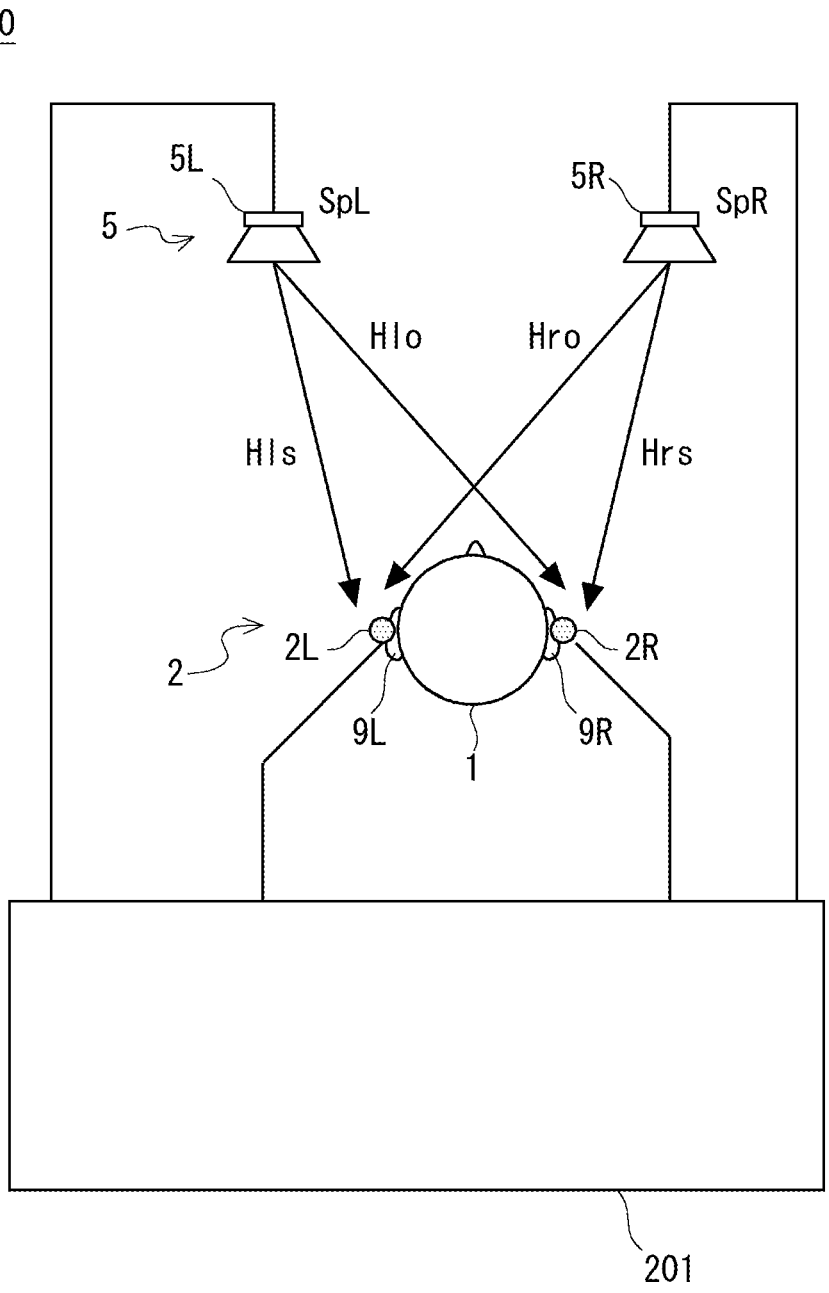
FIG. 2 shows a measurement configuration for measuring individual characteristics.

A filter generation device that measures spatial acoustic transfer characteristics (which are referred to hereinafter as transfer characteristics) and generates a filter is described hereinafter with reference to FIG. 2. FIG. 2 is a view schematically showing a configuration of a filter generation device 200. Note that the filter generation device 200 may be a common device to the out-of-head localization device 100 shown in FIG. 1. Alternatively, a part or the whole of the filter generation device 200 may be a different device from the out-of-head localization device 100.

As shown in FIG. 2, the filter generation device 200 includes stereo speakers 5, stereo microphones 2, and a signal processing unit 201. The stereo speakers 5 are placed in a measurement environment.

In this embodiment, the signal processing unit 201 of the filter generation device 200 performs a calculation process for appropriately generating filters corresponding to the transfer characteristics. The signal processing unit 201 may be a personal computer (PC), a tablet terminal, a smart phone, etc.

The signal processing unit 201 generates measurement signals and outputs the generated measurement signals to the stereo speakers 5. Note that the signal processing unit 201 generates, for example, impulse signals or TSP (Time Stretched Pulse) signals as the measurement signals for measuring the transfer characteristics. The measurement signals include measurement sounds such as impulse sounds. Further, the signal processing unit 201 acquires sound pickup signals picked up by the stereo microphones 2. The signal processing unit 201 includes a memory or the like that stores each measurement data of transfer characteristics.

The stereo speakers 5 include a left speaker 5L and a right speaker 5R. For example, the left speaker 5L and the right speaker 5R are placed in front of a measurement subject (i.e., a subject who undergoes the measurement) 1. The left speaker 5L and the right speaker 5R output impulse sounds for impulse response measurement and the like. In the following description, this embodiment is described under the assumption that the number of speakers, which serves as sound sources, is two (i.e., the assumption that the speakers are stereo speakers). However, the number of sound sources is not limited to two, i.e., may be any number no less than one. That is, this embodiment can be applied to a 1ch monaural environment, or the so-called multi-channel environment such as 5.1ch and 7.1ch.

The stereo microphones 2 include a left microphone 2L and a right microphone 2R. The left microphone 2L is placed on a left ear 9L of the measurement subject 1 and the right microphone 2R is placed on a right ear 9R of the measurement subject 1. To be specific, the microphones 2L and 2R are preferably placed at places between the entrances of the ear canals and the eardrums of the left ear 9L and the right ear 9R, respectively. The microphones 2L and 2R pick up measurement signals output from the stereo speakers 5 and outputs sound pickup signals to the signal processing unit 201. The measurement subject 1 may be a person or a dummy head. In other words, in this embodiment, the measurement subject 1 is a concept that includes not only a person but also a dummy head. In this example, it is assumed that the measurement subject 1 is the same person as the user U who listens to sounds through the out-of-head localization process device shown in FIG. 1.

As described above, measurement signals output from the left and right speakers 5L and 5R are picked up by the microphones 2L and 2R, and impulse responses are obtained based on the picked-up sound pickup signals. The filter generation device 200 stores the sound pickup signals acquired based on the impulse response measurement into a memory or the like. The transfer characteristics Hls between the left speaker 5L and the left microphone 2L, the transfer characteristics Hlo between the left speaker 5L and the right microphone 2R, the transfer characteristics Hro between the right speaker 5R and the left microphone 2L, and the transfer characteristics Hrs between the right speaker 5R and the right microphone 2R are thereby measured. Specifically, the left microphone 2L picks up the measurement signal that is output from the left speaker 5L, and thereby the transfer characteristics Hls are acquired. The right microphone 2R picks up the measurement signal that is output from the left speaker 5L, and thereby the transfer characteristics Hlo are acquired. The left microphone 2L picks up the measurement signal that is output from the right speaker 5R, and thereby the transfer characteristics Hro are acquired. The right microphone 2R picks up the measurement signal that is output from the right speaker 5R, and thereby the transfer characteristics Hrs are acquired.

Then, the filter generation device 200 generates filters according to the transfer characteristics Hls, Hlo, Hro and Hrs from the left and right speakers 5L and 5R to the left and right microphones 2L and 2R based on the sound pickup signals. By doing so, the filter generation device 200 generates filters which are used for the convolution calculation performed by the out-of-head localization device 100. As shown in FIG. 1, the out-of-head localization device 100 performs out-of-head localization by using filters corresponding to the transfer characteristics Hls, Hlo, Hro and Hrs between the left and right speakers 5L and 5R and the left and right microphones 2L and 2R. Specifically, the out-of-head localization process is performed by convolving the filters corresponding to the transfer characteristics to the audio reproduced signals.

The microphones 2L and 2R are ear microphones that are worn on ears. The microphones 2L and 2R can measure not only spatial acoustic transfer characteristics but also ear-canal transfer characteristics. Specifically, an earphone driver is detachably attached to each of the microphones 2L and 2R. By attaching the earphone drivers to the microphones, the signal processing unit 201 can measure ear-canal transfer characteristics. By removing the earphone drivers from the microphones, the signal processing unit 201 can measure spatial acoustic transfer characteristics.

A structure of each of the microphones 2L and 2R is described hereinafter. Note that since the microphones 2L and 2R have the same structure as each other, only the microphone 2L is described in the following description and the description of the microphone 2R is omitted.

First Embodiment

In this embodiment, a structure of an ear chip (also referred to as an ear pad) used for the microphone 2L is changed according to the size of an ear canal of a measurement subject 1 (i.e., a subject 1 who undergoes the measurement). That is, two types of ear chips having different sizes are prepared and they are selectively used according to the size of the ear canal of the measurement subject 1. The positions of microphone elements in the two ear chips are different from each other. It is preferable that the microphone element in the ear chip used for a measurement subject 1 having a large ear canal be positioned in a vertical arrangement (or a vertical position) and the microphone element in the ear chip used for a measurement subject 1 having a small ear canal be positioned in a horizontal arrangement (or a horizontal position). The orientation of the microphone element in the vertical arrangement differs from that in the horizontal arrangement by 90°.

(Structure in Vertical Arrangement)

Figure 3:
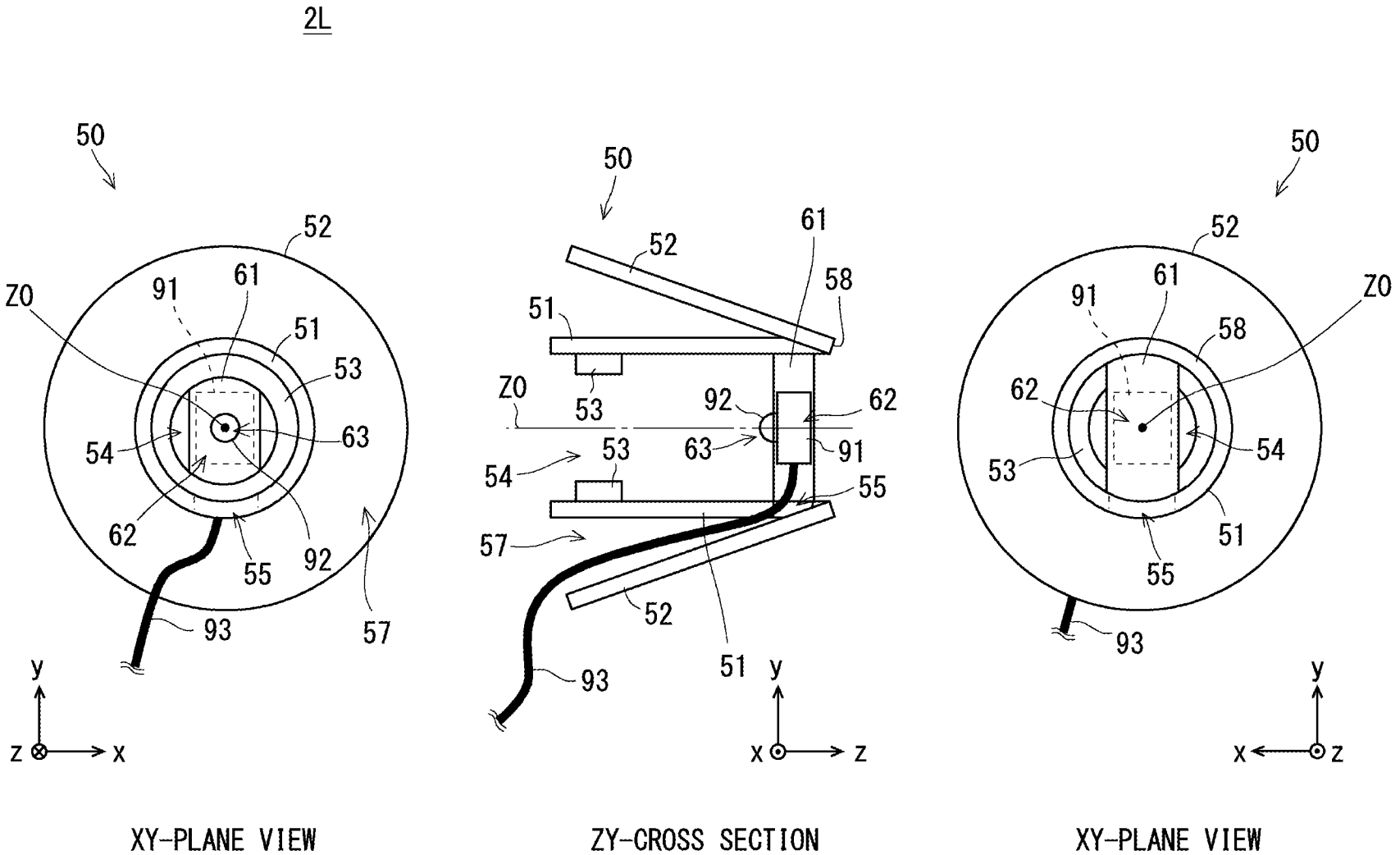
FIG. 3 shows a structure of a microphone in a vertical arrangement.

FIG. 3 is a diagram schematically showing a structure of an ear chip 50 in the vertical arrangement. Note that the drawings described below are simplified as appropriate and do not reflect the actual shape and dimensions. In the drawings, XYZ three-dimensional orthogonal coordinate systems are shown for simplifying the explanation. A direction along an ear canal is defined as a Z-direction and is also referred to as an axial direction. An XY-plane is a plane orthogonal to the Z-direction. Note that even in a state where a microphone 2L is not worn on the ear, the above-described XYZ-directions are applied. A central part in FIG. 3 shows a ZY-cross section and a right part shows an XY-plane view as viewed from the eardrum side of the ear canal. Further, a left part shows an XY-plane view viewed from the outside of the ear canal (they also apply to FIGS. 5, 28, 30 and 32 described later).

FIG. 3 shows a microphone 2L in a state in which no speaker driver is attached thereto. That is, a state in which the speaker driver is detached from the ear chip 50 in the microphone 2L in order to measure spatial acoustic transfer characteristics is described.

On the XY-plane, the central axis of the ear canal is defined as a central axis Z0. Further, by using a circle around the central axis Z0 as a base circle, a circumferential direction and a radial direction are defined. A +Z side is the inner side of the ear canal (i.e., the eardrum side) and a −Z side is the outer side of the ear canal.

The microphone 2L includes an ear chip 50 and a microphone element 91. The ear chip 50 is formed of an elastic material and press-fitted into an ear canal. For example, the ear chip 50 is formed in a shape of a hollow artillery shell.

The ear chip 50 includes a cylindrical part 51, a contact part 52, a projection part 53, and a connecting part 58, and a column part 61. The ear chip 50 is formed of, for example, an elastic material such as a silicone resin. That is, the ear chip 50 is a resin-molded article in which the cylindrical part 51, the contact part 52, the connecting part 58, and the column part 61 are integrally molded. The total length of the ear chip 50 in the Z-direction is about 8.5 mm.

The cylindrical part 51 has a cylindrical shape extending along the ear canal and has a hollow part 54. That is, the cylindrical part 51 is a tube made of a silicone resin. The hollow part 54 has a circular cross section. Note that the center of the axis of the cylindrical part 51 coincides with the central axis Z0 of the ear canal. The inner diameter of the cylindrical part 51, i.e., the diameter of the hollow part 54 is about 5 mm.

The contact part 52 is disposed outside the cylindrical part 51 and comes into contact with the inner wall surface of the ear canal. The ear chip 50 is formed in a shape of a hollow artillery shell. Therefore, the outer diameter of the contact part 52 gradually increases from the +Z side toward the −Z side. Alternatively, the contact part 52 may be formed in a cylindrical shape having a constant outer diameter. The maximum outer diameter of the contact part 52 is about 12 mm.

When the ear chip 50 is fitted into the ear canal, the contact part 52 comes into contact with the inner wall surface of the ear canal and is deformed. The contact part 52 contracts inward in the radial direction and generates an outward elastic force in the radial direction. The ear chip 50 is fixed in the ear canal by the elastic force of the contact part 52.

The cylindrical part 51 is disposed on the inner side of the contact part 52 (on the central axis Z0 side). The contact part 52 and the cylindrical part 51 are connected to each other through the connecting part 58 on the +Z side (on the eardrum side of the ear canal). The connecting part 58 is disposed at the tip of the ear chip 50 on the +Z side. Further, the connecting part 58 connects the contact part 52 with the cylindrical part 51 over the entire circumference. A gap 57 is provided in the space between the contact part 52 and the cylindrical part 51. The cylindrical part 51 serves as an inner skin having a wall thickness of about 0.5 to 2.0 mm and the contact part 52 serves as an outer skin having a wall thickness of about 0.1 to 1.0 mm.

In this embodiment, the contact part 52 has a foldable flange structure. That is, the contact part 52 can be turned inside out toward the +Z side while using the connecting part 58 as a base point (i.e., as a base line) (see FIG. 4). By bringing the contact part 52 into the inside-out state, the microphone element 91 can be attached and detached. The contact part 52 is a flange part extending from one end of the cylindrical part 51. An end of the contact part 52 on the +Z side is connected to the cylindrical part 51 through the connecting part 58. Further, an end of the contact part 52 on the −Z side is an open end.

The projection part 53 is provided on the inner side of the cylindrical part 51. The projection part 53 serves as a locking piece for locking a speaker driver as described later. That is, the projection part 53 is disposed on the −Z side of the column part 61. In FIG. 3, the projection part 53 is formed over the entire circumference. However, the projection part 53 may be formed only in a part(s) of the entire circumference. Further, in the case where the speaker driver is press-fitted into the cylindrical part 51, the projection part 53 is unnecessary.

The column part 61 is provided inside the cylindrical part 51. The column part 61 is disposed near the end of the cylindrical part 51 on the +Z side. The column part 61 is provided along the Y-direction. Specifically, the column part 61 is disposed so as to cross the hollow part 54 and is connected to the inner circumferential surface of the cylindrical part 51. That is, both ends of the column part 61 in the Y-direction are connected to the inner peripheral surface of the cylindrical part 51. The column part 61 is provided so as to extend from the end of the hollow part 54 on the +Y side to the end thereof on the −Y side. Note that although the column part 61 is provided so as to extend along the Y-direction, it may be provided so as to extend along the X-direction or along other directions on the XY-plane.

The microphone element 91 is attached to the column part 61. The microphone element 91 is a MEMS (Micro Electrical Mechanical System) microphone. The microphone element 91 includes a rectangular substrate (or a square substrate) with each side of about 2 to 3 mm and having a thickness of about 1 mm. A sound pickup part 92 is provided in the microphone element 91. The sound pickup part 92 has a circular shape having a diameter of about 0.8 mm in a plan view. The sound pickup part 92 includes a sound pickup hole(s), a diaphragm, etc. The sound pickup part 92 converts vibrations of the diaphragm into an electric signal and outputs the obtained electric signal through a cable 93. The sound pickup part 92 is disposed on the central axis Z0.

The column part 61 includes a housing part 62 for storing the microphone element 91. Specifically, the housing part 62 is an internal space provided in the column part 61. The housing part 62 is connected to an opening 55 (which will be described later). The microphone element 91 is fitted in the housing part 62. Further, a microphone hole 63 is formed on the central axis Z0 of the column part 61. The microphone hole 63 communicates with the housing part 62 (i.e., is connected with the internal space of the housing part 62). The sound pickup part 92 of the microphone element 91 is disposed in the microphone hole 63. In this way, it is possible to fix the microphone element 91 at an appropriate position. The microphone element 91 is fixed to the column part 61 so that the sound pickup part 92 faces the −Z side. For example, the thickness direction of the microphone element 91 coincides with the Z-direction. That is, the sound pickup direction of the microphone element 91 is in parallel with the Z-direction. Note that the sound pickup direction is a direction perpendicular to the diaphragm of the sound pickup part 92.

The cable 93 is connected to the microphone element 91. The cable 93 includes a power supply cable, a signal cable, and so on, and is electrically connected to a power supply terminal, a signal terminal, a ground terminal, and so on of the microphone element 91. The cable 93 passes through the opening 55 provided in the side wall of the cylindrical part 51 and is led out to the gap 57. That is, the cable 93 is connected to the microphone element 91 from the −Y side. Further, one end of the cable 93 is connected to the microphone element 91 and the other end thereof is led out from the gap 57 to the outside of the ear canal. The opening 55 is formed near the end of the cylindrical part 51 on the −Y side.

Figure 4:
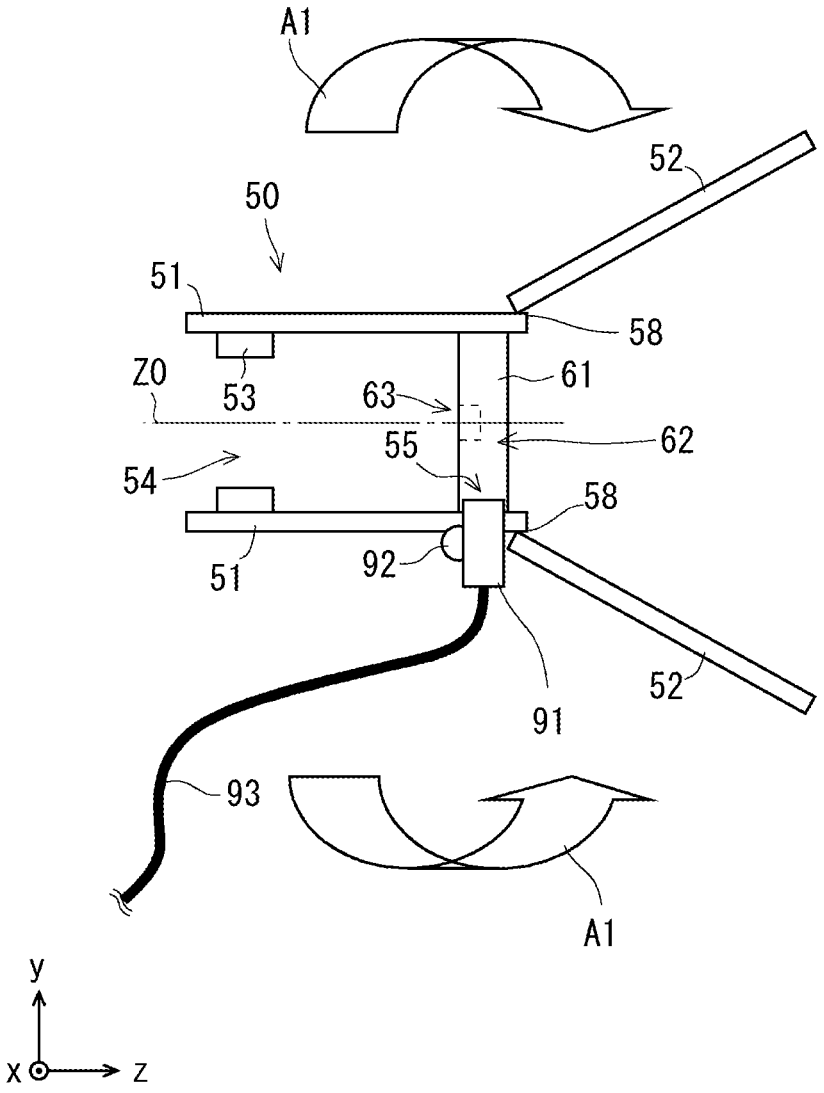
FIG. 4 is a diagram for explaining a state in which a microphone element is attached in a vertical arrangement.

FIG. 4 shows a state in which the microphone element 91 is disposed inside the cylindrical part 51 in a vertical arrangement (i.e., a vertical position). As described above, the contact part 52 is turned inside out in a direction indicated by arrows A1 while using the connecting part 58 as the base point (i.e., as the base line). Therefore, the microphone element 91 can be inserted into the opening 55.

Specifically, the microphone element 91 can be inserted in the +Y direction through the opening 55 formed in the side wall of the cylindrical part 51. That is, as the microphone element 91 is pushed from the opening 55 in the +Y direction, the microphone element 91 passes through the opening 55 and is fitted into the housing part 62 of the column part 61. The microphone element 91, which has passed through the opening 55 from the outside of the cylindrical part 51, is housed in the housing part 62 of the column part 61.

The microphone element 91 is inserted in the +Y direction until the sound pickup part 92 of the microphone element 91 reaches the microphone hole 63. In this way, the microphone element 91 can be attached to the column part 61. The cable 93 connected to the microphone element 91 passes through the opening 55 and is led to the outside of the hollow part 54. Then, by restoring the inside-out contact part 52 to the original position, the structure shown in FIG. 3 is obtained. That is, the contact part 52 is restored to the position shown in FIG. 3 by folding back the contact part 52 in a direction opposite to the arrows A1 while using the connecting part 58 as the base point (i.e., as the base line).

In the folded-back state, the opening 55 is covered by the contact part 52. Therefore, the position of the microphone element 91 is fixed. Further, since the contact part 52 covers the opening 55, airtightness of the sound path can be improved. Further, the contact part 52 is disposed between the cable 93 and the inner wall of the ear canal. Therefore, it is possible to prevent the cable 93 from coming into contact with the inner wall of the ear canal. In this way, it is possible to reduce occurrences of noises which would otherwise be caused by pulse noises or the like of the measurement subject 1.

As described above, when the internal diameter of the ear canal of the measurement subject 1 is large, it is preferable to use the ear chip 50 in which the column part 61 is disposed inside the cylindrical part 51. Even when the ear chip 50 is strongly pushed into the ear canal, the ear chip 50 can be prevented from being significantly deformed. Therefore, it is possible to prevent the orientation of the microphone element 91 from being significantly inclined and thereby to appropriately pick up sounds.

Further, since the sound pickup part 92 of the microphone element 91 faces outward, sounds can be appropriately picked up. Further, the column part 61 and the microphone element 91 are arranged so that they do not block the hollow part 54. Since the hollow part 54 communicates with the eardrum through both sides of the column part 61, the hollow part 54 serves as a sound path from the outside of the ear canal to the eardrum. It is possible to appropriately pick up sounds without blocking the sound path.

The microphone element 91 can be disposed in a place closer to the eardrum, thus making it possible to pick up sounds in the ideal sound pickup place. Further, the opening 55 through which the cable 93 passes is provided in the ear chip 50. Further, the cable 93 is led out to the gap 57 through the opening 55. That is, it is possible to reduce the influence of the wiring of the cable 93, thus making it possible to appropriately pick up sounds.

As described above, according to this embodiment, it is possible to measure individual characteristics in a state in which the microphone element 91 is disposed in an appropriate place. Further, the microphone element 91 can be reliably fixed without using an adhesive. Since no adhesive is used, the microphone element 91 can be removed by turning the contact part 52 inside out.

[Structure in Horizontal Arrangement]

Figure 5:
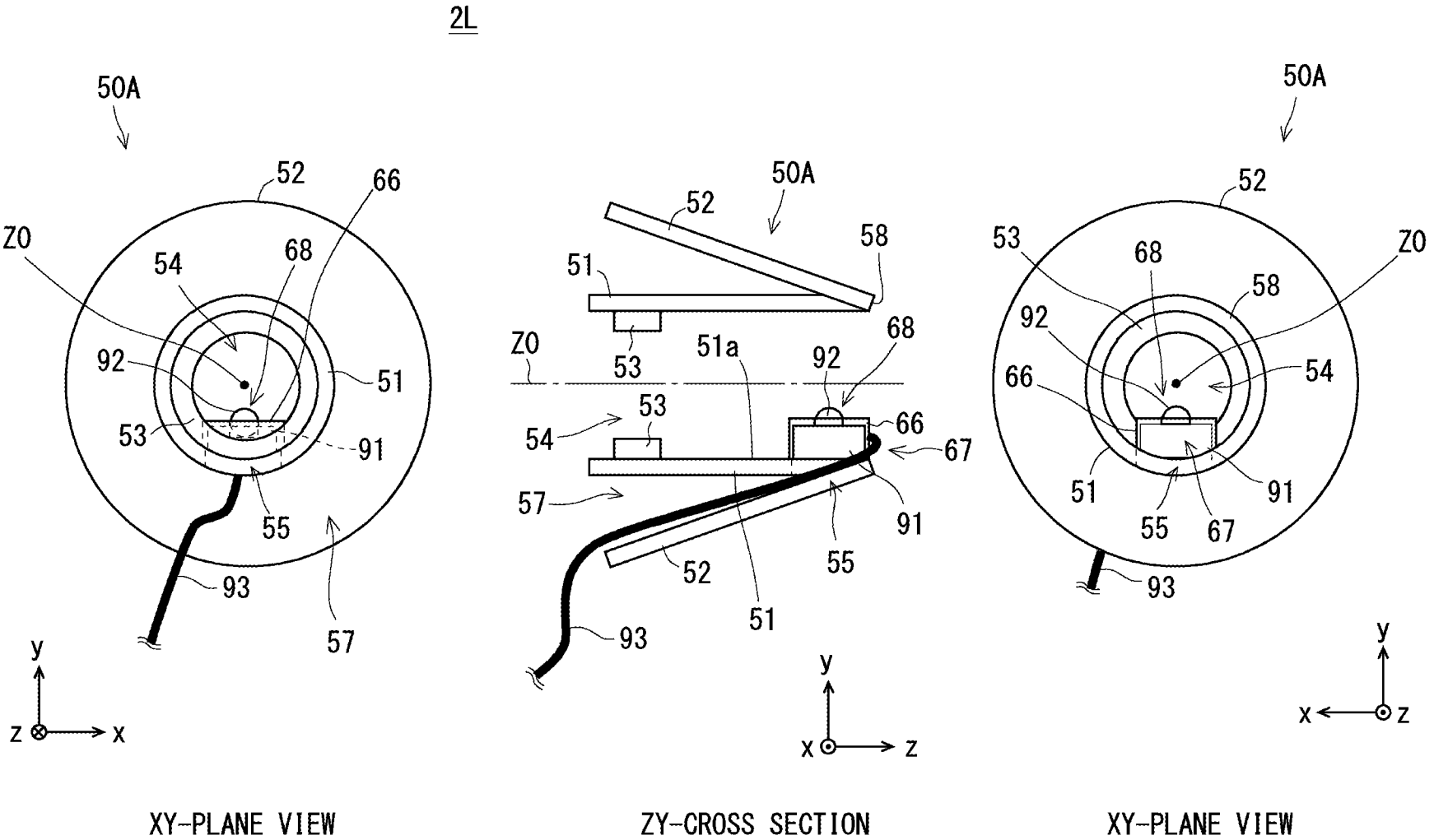
FIG. 5 shows a structure of a microphone in a horizontal arrangement.

Next, a structure of an ear chip 50A in the horizontal arrangement is described with reference to FIG. 5. A central part in FIG. 5 shows a YZ-cross section and a right part in FIG. 5 shows an XY-plane view viewed from the eardrum side of the ear canal. Further, a left part in FIG. 5 shows an XY-plane view viewed from the outside of the ear canal.

In the structure in the horizontal arrangement, the ear chip 50A includes no column part 61. Further, a housing part 67 is provided on the inner circumferential surface 51*a* of the cylindrical part 51. That is, a holding part 66 is provided in place of the column part 61 in the ear chip 50A. The basic shapes, the sizes, etc. of the cylindrical part 51, the contact part 52, the projection part 53, etc. are the same as those of the ear chip 50. The cylindrical part 51, the contact part 52, the projection part 53, and the holding part 66 are integrally formed.

The holding part 66 protrudes from the inner circumferential surface 51*a* to the central axis Z0 side. The holding part 66 is disposed in the hollow part 54. The holding part 66 is a hollow block and its surface on the +Z side is opened. The internal space of the holding part 66 serves as a housing part 67 for disposing a microphone element 91 therein. Further, a microphone hole 68 is provided on a surface on the +Y side of the holding part 66.

The position of the microphone element 91 is deviated from the central axis Z0. In this example, the microphone element 91 is disposed on the −Y side of the central axis Z0. A sound pickup part 92 of the microphone element 91 is disposed so as to face the +Y side. Therefore, the sound pickup direction of the microphone element 91 is in parallel with the Y-direction. The microphone element 91 is disposed near the end of the cylindrical part 51 on the +Z side.

Further, in the horizontal arrangement, a surface on the +Z side of the holding part 66 is opened and the cable 93 is connected to the microphone element 91 from the +Z side. Similarly to the vertical arrangement, an opening 55 is formed in the ear chip 50A. In the ear chip 50A with the horizontal arrangement, the place where the opening 55 is formed is not limited to the cylindrical part 51. That is, the opening 55 may be formed in the connecting part 58 or the contact part 52. The cable 93 passes through the opening 55 and is led out to the gap 57. The cable 93 is led from the gap 57 to the outside of the ear canal.

In the horizontal arrangement, the ear chip 50A can be configured so that no column part 61 crossing the hollow part 54 is provided. Therefore, it is possible to increase the amount of the elastic deformation of the ear chip 50A and thereby to fit the ear chip 50A into a smaller ear canal. The microphone element 91 is supported on the inner circumferential surface 51*a* of the cylindrical part 51, instead of being supported on the column part 61. Therefore, even when the ear chip 50A is deformed, the microphone element 91 is not significantly inclined.

The microphone element 91 can be disposed in a place closer to the eardrum. The holding part 66 and the microphone element 91 are arranged so that they do not block the hollow part 54. The hollow part 54 forms a sound path that communicates with (i.e., extends to) the eardrum. It is possible to appropriately pick up sounds without blocking the ear canal (the sound path) extending to the eardrum.

Figure 6:
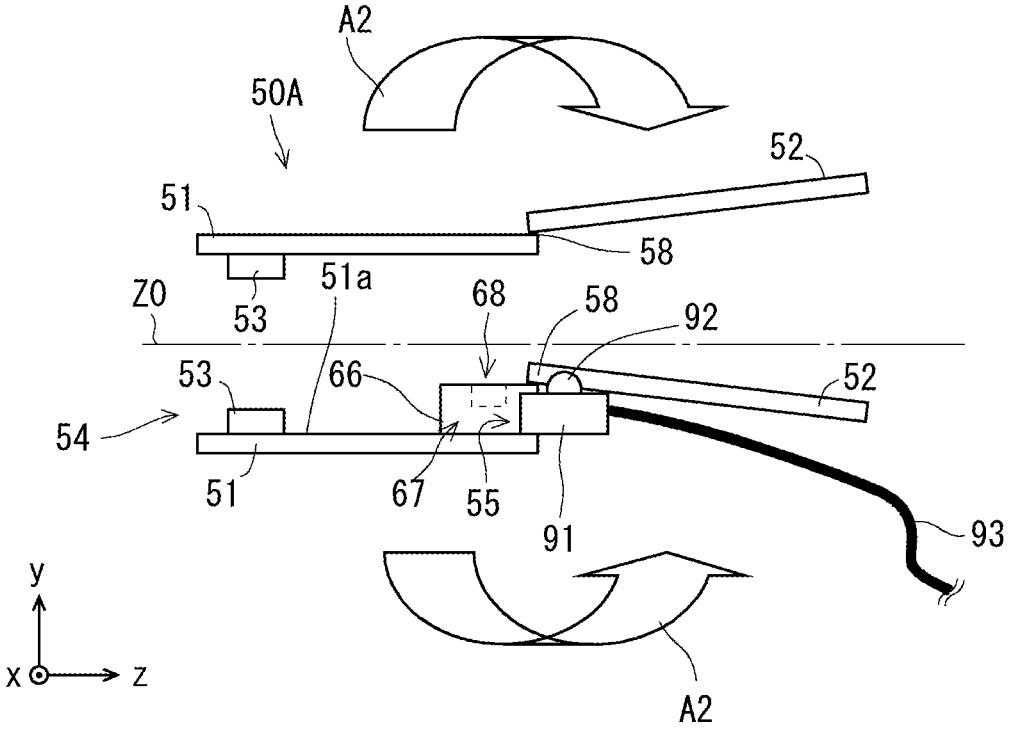
FIG. 6 is a diagram for explaining a state in which a microphone element is attached in a horizontal arrangement.

Next, FIG. 6 shows a state in which the microphone element 91 is disposed inside the cylindrical part 51 in the horizontal arrangement. The contact part 52 is in a state in which it is turned inside out in a direction indicated by arrows A2 while using the connecting part 58 as a base point (i.e., as a base line). Therefore, the microphone element 91 can be inserted into the opening 55.

Specifically, the microphone element 91 can be inserted in the −Z direction through an opening 55 formed near the connecting part 58. The microphone element 91 passes through the opening 55 and is fitted into the holding part 66.

The microphone element 91 is inserted in the −Z direction until the sound pickup part 92 of the microphone element 91 reaches the microphone hole 68. That is, by pushing the microphone element 91 in the −Z direction, the microphone element 91 is housed in the housing part 67. In this way, the microphone element 91 can be attached to the holding part 66.

Then, by restoring the inside-out contact part 52 to the original position, the structure shown in FIG. 5 is obtained. That is, the contact part 52 is restored to the position shown in FIG. 5 by folding back the contact part 52 in a direction opposite to the arrows A2 while using the connecting part 58 as the base point (i.e., as the base line). In this state, since the opening 55 is covered by the contact part 52, it is not exposed to the outside. The cable 93 connected to the microphone element 91 passes through the opening 55 and is led to the outside of the hollow part 54. That is, the cable 93 passes through the gap 57 between the cylindrical part 51 and the contact part 52 and is led to the outside of the ear canal.

As described above, when the internal diameter of the ear canal of the measurement subject 1 is small, the ear chip 50A in which the holding part 66 is disposed inside the cylindrical part 51 is used. The height of the holding part 66 in the Y-direction may be roughly equal to the thickness of the substrate of the microphone element 91. It is possible to dispose the holding part 66 and the microphone element 91 so that they do not block the hollow part 54. In this way, it is possible to appropriately pick up sounds without blocking the ear canal extending to the eardrum.

The microphone element 91 can be disposed in a place closer to the eardrum, thus making it possible to pick up sounds in the ideal sound pickup place. Further, the opening 55 through which the cable 93 passes is provided in the ear chip 50A. Further, the cable 93 is led out to the gap 57 through the opening 55. That is, it is possible to reduce the influence of the wiring of the cable 93, thus making it possible to appropriately pick up sounds.

The microphone element 91 can be disposed in a place closer to the eardrum. Further, the cable 93 is led out to the gap 57 through the opening 55. That is, it is possible to reduce the influence of the wiring of the cable 93, thus making it possible to appropriately pick up sounds. The microphone element 91 can be removed by turning the contact part 52 inside out.

Which of the vertical arrangement and the horizontal arrangement should be used may be determined according to the size of the ear canal of the measurement subject 1. That is, the measurement subject 1 may attach the ear chip 50 and the ear chip 50A in turn and determine which is more comfortable to wear. By doing so, the measurement subject 1 may select an appropriate ear chip. Specifically, if the ear chip 50 with the vertical arrangement cannot be inserted all the way in the ear canal, the ear chip 50A with the horizontal arrangement may be used. Further, a plurality of ear chips 50 and 50A may be prepared for respective sizes. For example, for each of the ear chips 50 and 50A, three ear chips having different sizes, i.e., a large size, a medium size, and a small size are prepared. Then, an ear chip having an optimal size may be selected according to the size of the ear canal.

[Structure of Ear Chip 50]

Figure 7:
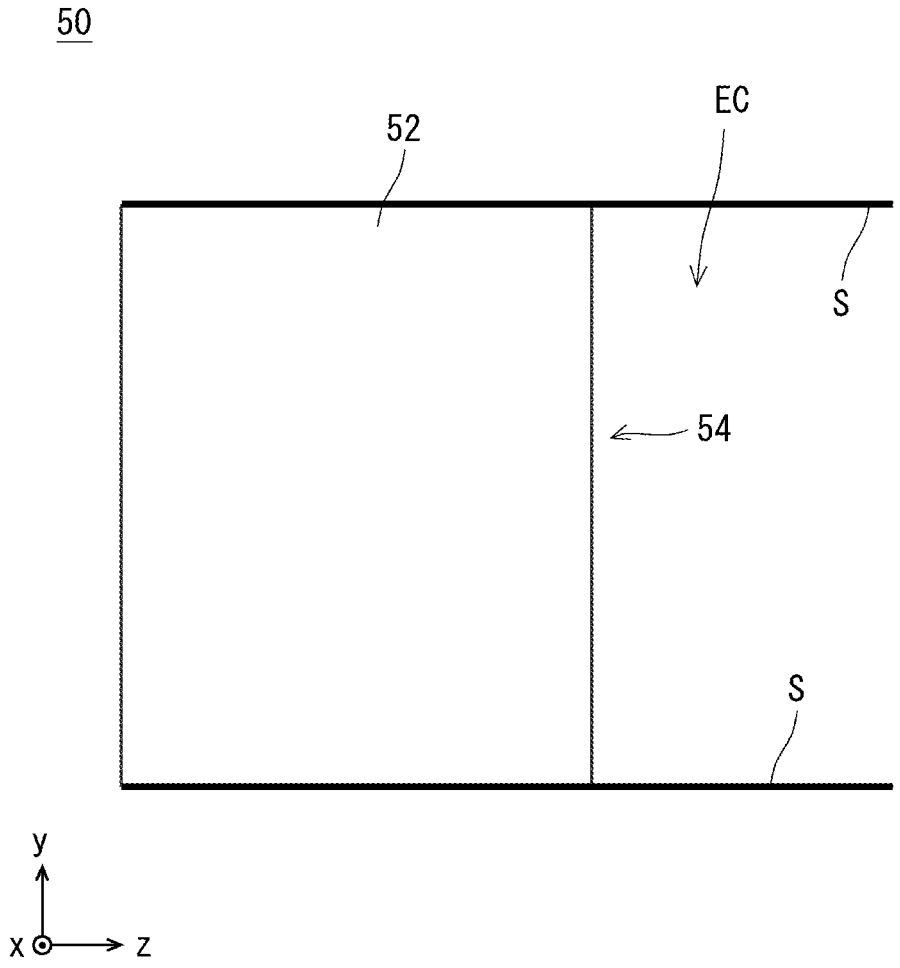
FIG. 7 is a side view showing an ear chip in a folded state.
Figure 8:
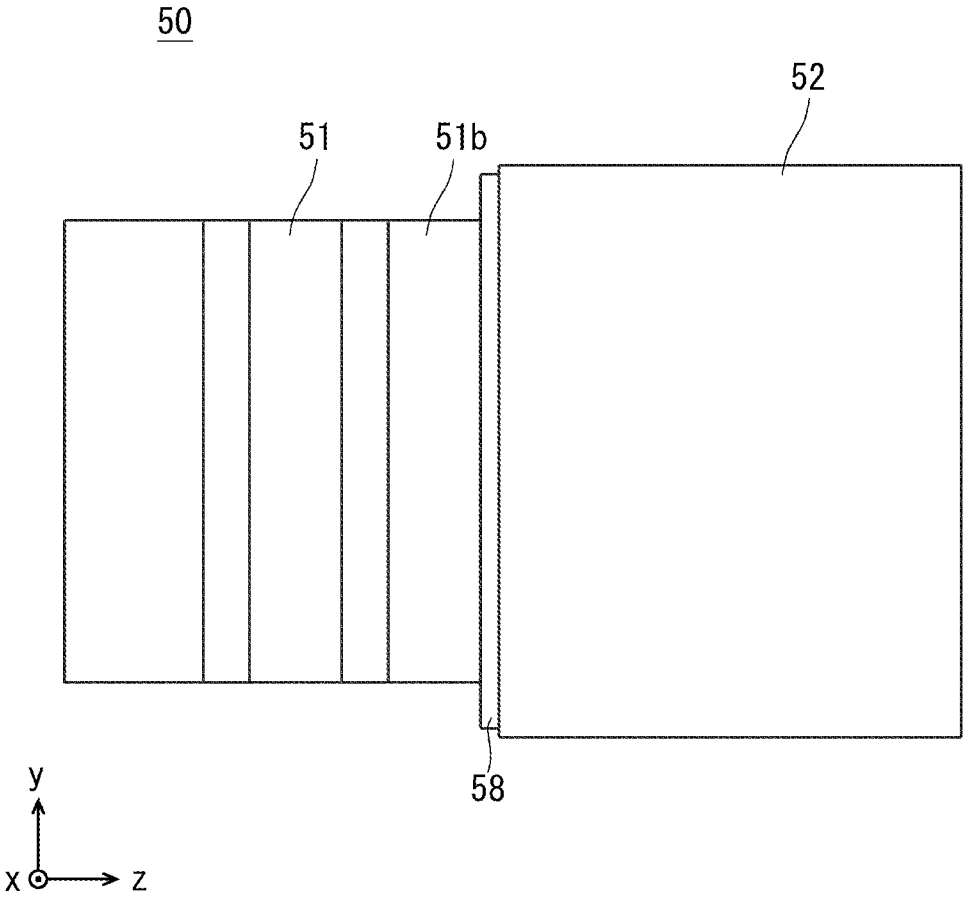
FIG. 8 is a side view showing an ear chip in an upside-down state.

Next, an example of a specific structure for the ear chip 50 with the vertical arrangement is described. FIG. 7 is a side view showing an ear chip 50 in a state where a contact part 52 is folded back (hereinafter referred to as a folded-back state). FIG. 8 is a side view showing the ear chip 50 in a state in which the contact part 52 is turned inside out (referred to as an inside-out state). As shown in FIGS. 7 and 8, the contact part 52 has a cylindrical outer shape. That is, the contact part 52 has a constant outer diameter irrespective of the position in the Z-direction. Further, illustration of the projection part 53 is omitted in the drawings described below.

As shown in FIG. 7, in the folded-back state, the outer circumferential surface of the cylindrical part 51 is covered by the contact part 52. Further, the contact part 52 is in contact with an inner wall surface S of an ear canal EC. As shown in FIG. 8, by turning the contact part 52 inside out, the outer circumferential surface 51*b* of the cylindrical part 51 is exposed. In the inside-out state, when the connecting part 58 is defined as the base point (i.e., the base line), the contact part 52 extends to the +Z side and the cylindrical part 51 extends to the −Z side. The contact part 52 is larger than the outer diameter of the cylindrical part 51.

Figure 9:
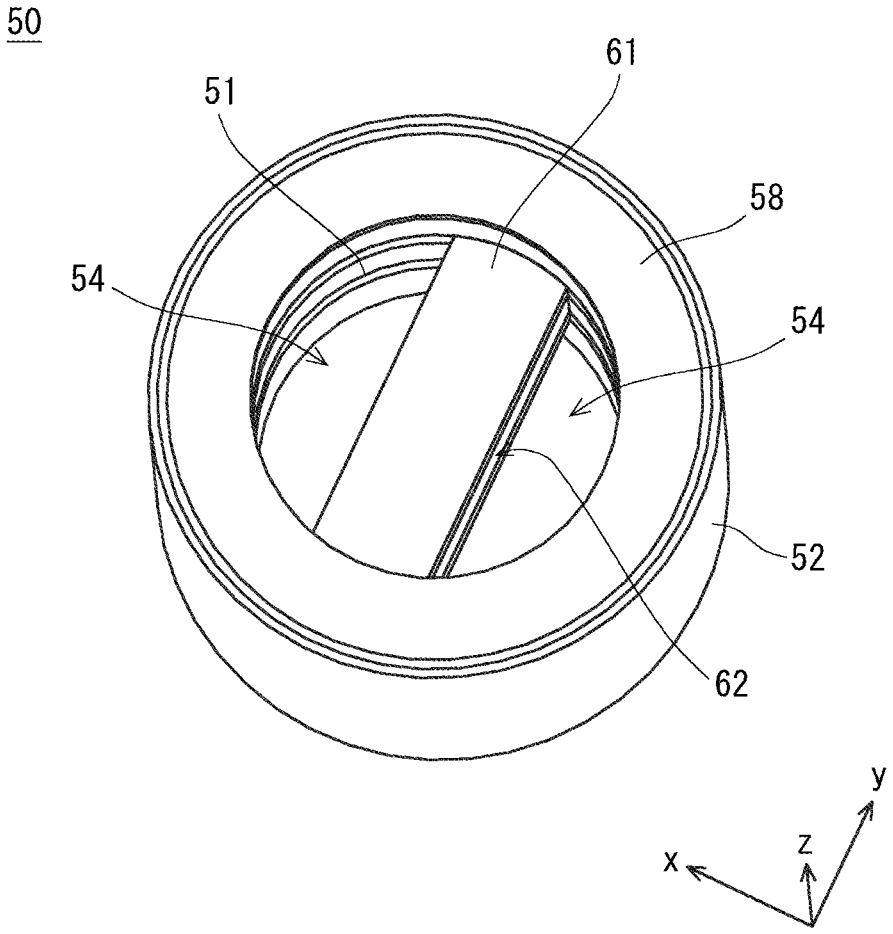
FIG. 9 is a perspective view of an ear chip in a folded state as viewed from an eardrum side.
Figure 10:
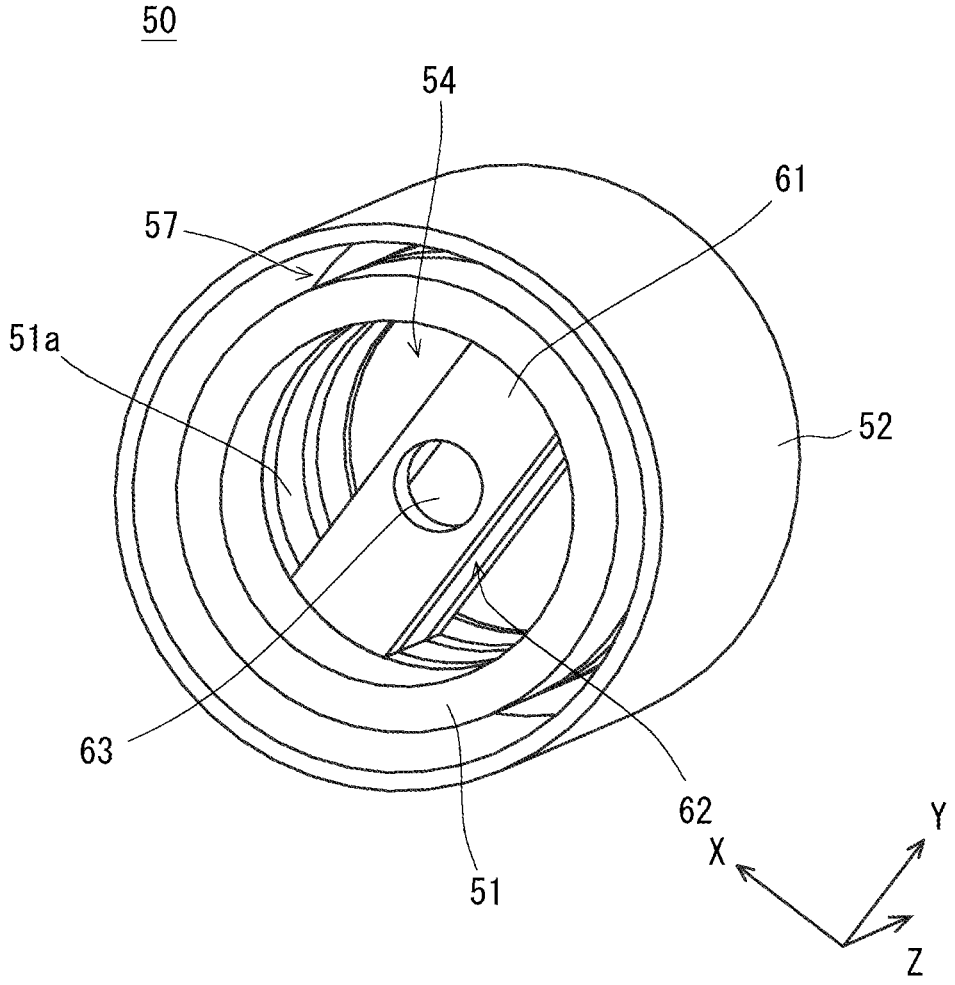
FIG. 10 is a perspective view of an ear chip in a folded state as viewed from outside of an ear canal.
Figure 11:
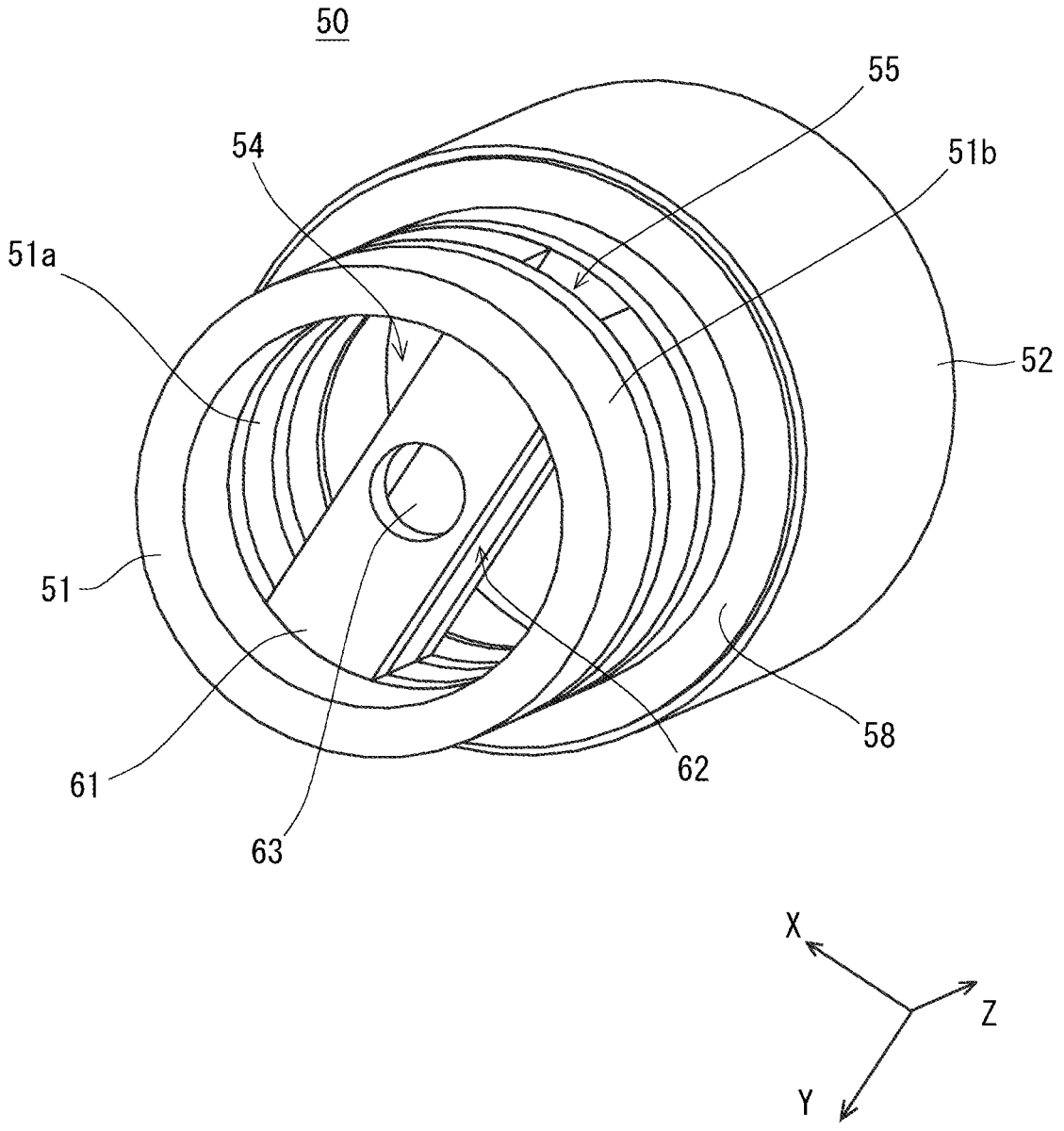
FIG. 11 is a perspective view showing an ear chip in an upside-down state.
Figure 12:
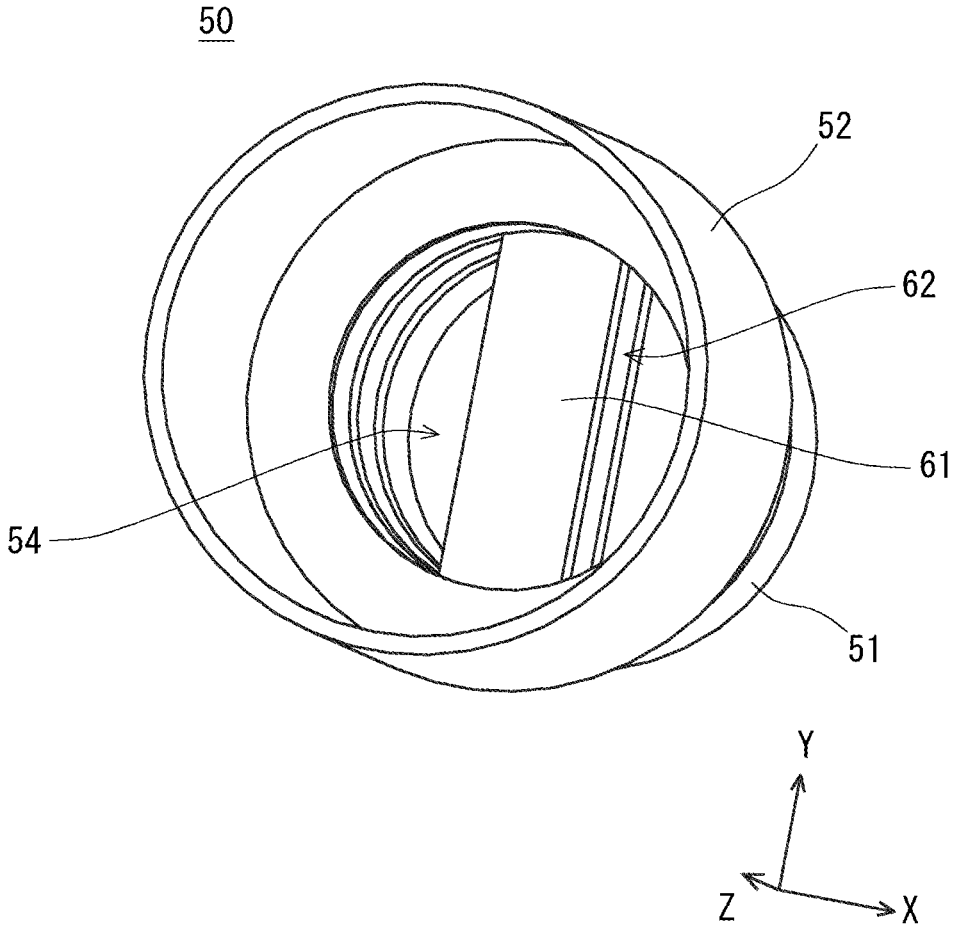
FIG. 12 is a perspective view showing an ear chip in an upside-down state.
Figure 13:
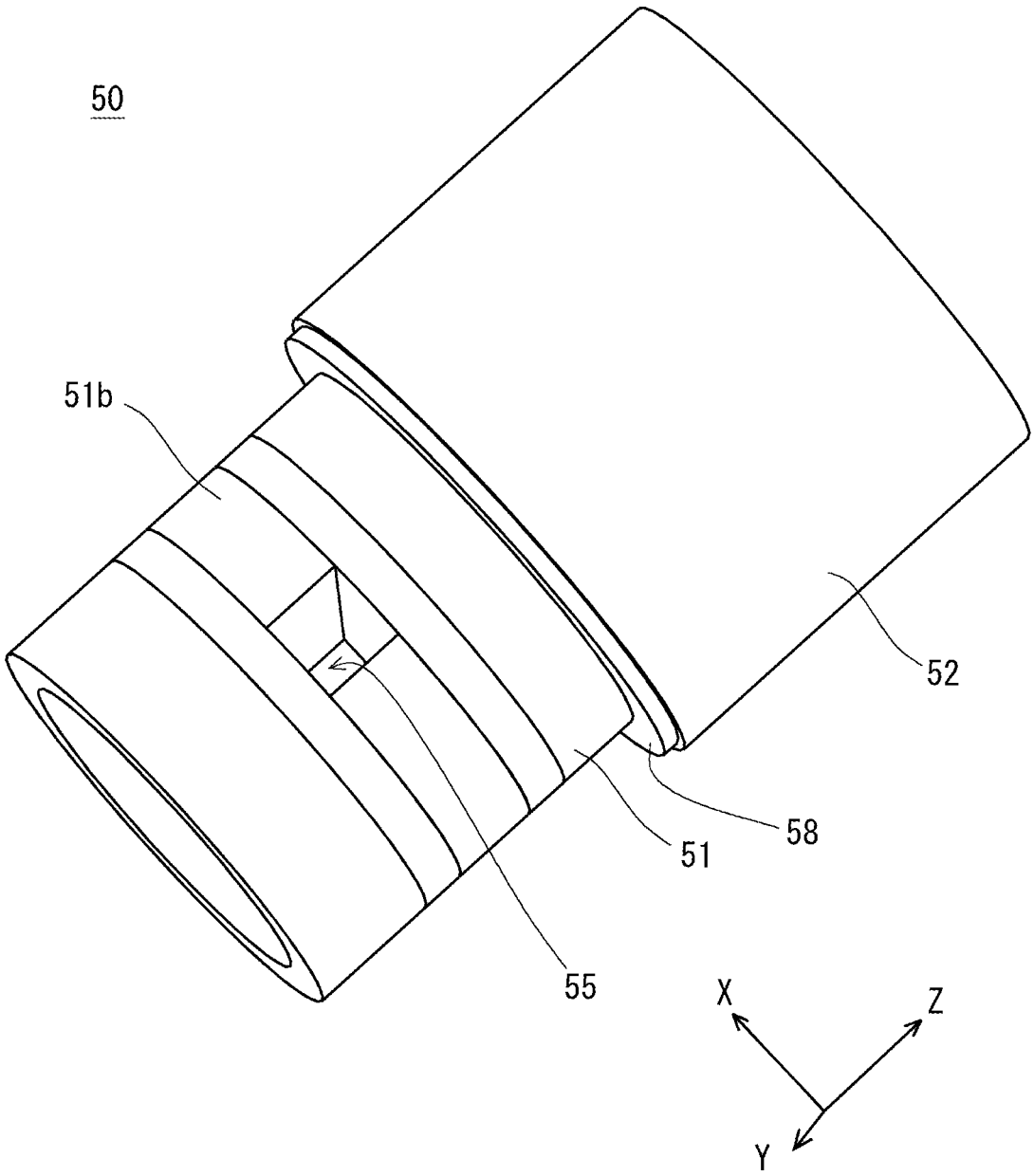
FIG. 13 is a perspective view showing an ear chip in an upside-down state.

FIGS. 9 and 10 are perspective views showing an ear chip 50 in a folded-back state. FIGS. 11, 12 and 13 are perspective views showing the ear chip 50 in an inside-out state. While FIGS. 9 and 12 are views as viewed from the eardrum side, FIGS. 10 and 11 are views as viewed from the outside of the ear canal. FIG. 13 is a view as viewed from the opening 55 side.

As shown in FIGS. 9 and 10, a column part 61 is provided so as to extend along the Y-direction. Therefore, both sides of the column part 61 in the X-direction serve as sound paths. Therefore, it is possible to pick up sounds without blocking the space to the eardrum.

As shown in FIGS. 10 and 11, a housing part 62 for housing a microphone element 91 therein is formed in the center of the column part 61. The housing part 62 is a space for housing the microphone element 91 therein. A circular microphone hole 63 in which the sound pickup part 92 of the microphone element 91 is disposed is formed in the column part 61. The housing part 62 communicates with the microphone hole 63.

As shown in FIG. 11, the opening 55 provided in the cylindrical part 51 is exposed by folding back the contact part 52. Further, the housing part 62 of the column part 61 is disposed in a place where the opening 55 is formed. As shown in FIG. 13, the opening 55 having a rectangular shape is provided in the cylindrical part 51.

By folding back the contact part 52, the opening 55 is exposed. Therefore, the microphone element 91 (see, for example, FIGS. 3 and 4) can be easily attached. When the measurement subject 1 is wearing the microphone 2L in the ear (hereinafter expressed as "the microphone wearing state"), the contact part 52 is in the folded-back state. Therefore, since the contact part 52 covers the opening 55, the microphone element 91 can be prevented from coming off (i.e., from being disengaged). Further, the cable 93 passes through a gap 57 between the cylindrical part 51 and the contact part 52. Therefore, it is possible to prevent the cable 93 from coming into contact with the inner wall surface S of the ear canal EC. It is possible to prevent the microphone element 91 from accidentally entering the ear canal even if the cable 93 is cut off in the microphone wearing state.

[Attachment of Earphone Driver]

Figure 14:
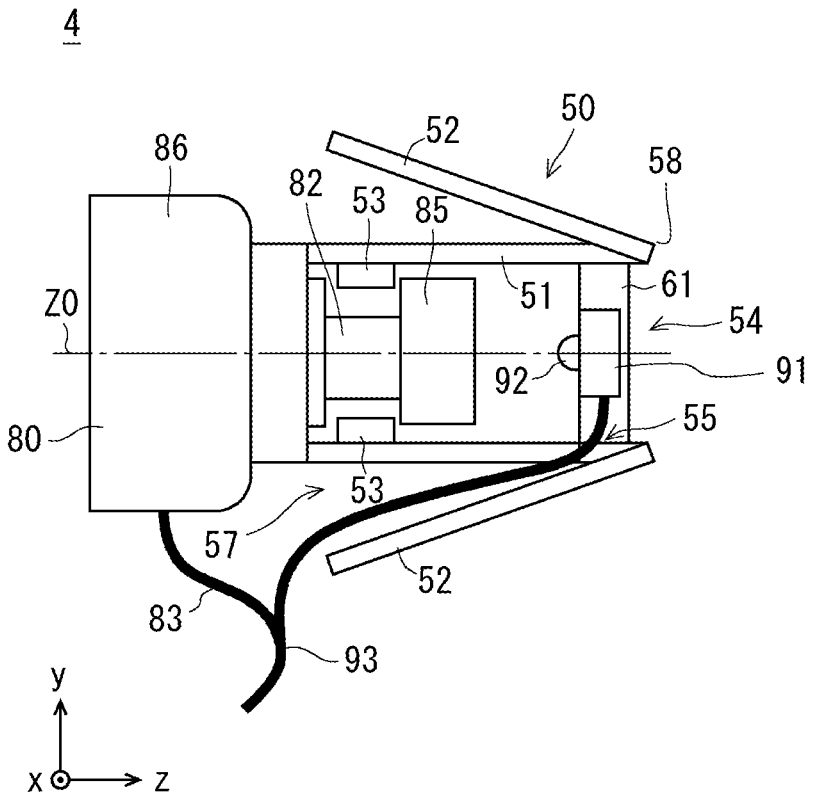
FIG. 14 is a cross-sectional side view showing a state in which an earphone driver is attached to an ear chip in a vertical arrangement.
Figure 15:
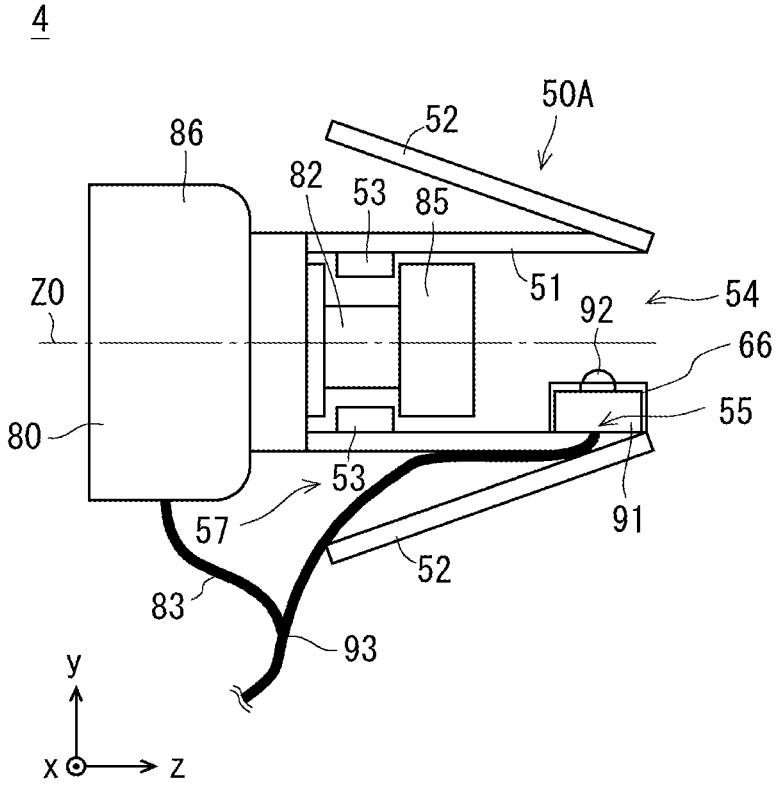
FIG. 15 is a cross-sectional side view showing a state in which an earphone driver is attached to an ear chip in a horizontal arrangement.

Next, a structure in which an earphone driver is attached to an ear chip 50 is described with reference to FIGS. 14 and 15. FIG. 14 is a cross-sectional side view showing a structure of a microphone 2L in which an earphone driver 80 is attached to an ear chip 50. FIG. 15 is a cross-sectional side view showing a structure of a microphone 2L in which an earphone driver 80 is attached to an ear chip 50A.

Each of FIGS. 14 and 15 shows the microphone 2L, in which the earphone driver 80 is attached, as a sound pickup device 4. The sound pickup device 4 is an earphone equipped with a microphone, including the ear chip 50 or 50A, a microphone element 91, and an earphone driver 80.

The earphone driver 80 includes a sound tube part 82, a driver cable 83, a front-end part 85, and a base part 86. The base part 86 is a part positioned outside the ear canal when the sound pickup device 4 is put in the ear. The sound tube part 82 is a part extending from the base part 86 to the eardrum side along the central axis Z0, and has a cylindrical shape. The front-end part 85 is a part disposed on the eardrum side of the sound tube part 82.

A diaphragm and a driving unit are housed inside the base part 86. The driving unit includes an actuator for vibrating the diaphragm according to an electric signal. Specifically, an actuator such as a piezoelectric element and a voice coil is disposed inside the base part 86. The base part 86 has an outer shape larger than the sound tube part 82 and the front-end part 85. The outer diameter of the base part 86 is larger than the inner diameter of the cylindrical part 51. The base part 86 is disposed outside the cylindrical part 51.

The sound tube part 82 extends on the +Z side of the base part 86. The sound tube part 82 has a cylindrical shape. That is, the interior of the sound tube part 82 is hollow. The front-end part 85 is a part disposed in a place closest to the eardrum and has an outer shape larger than the sound tube part 82. The front-end part 85 has a cylindrical shape. Note that a nonwoven fabric or the like for preventing dusts and the like from entering the inside of the earphone driver 80 may be provided in the front-end part 85. A sound generated in the base part 86 is output through the sound tube part 82 and the front-end part 85. The end surface of the front-end part 85 on the +Z side serves as a sound output surface. A sound (vibrations of air) output from the front-end part 85 propagates through the hollow part 54 and is picked up by the microphone element 91.

The front-end part 85 and the sound tube part 82 are inserted into the cylindrical part 51. That is, the front-end part 85 and the sound tube part 82 are disposed in the hollow part 54. The earphone driver 80 is locked in the ear chip 50 or 50A by a protrusion part 53. That is, the sound tube part 82 is inserted into the cylindrical part 51 so that its front-end part 85 passed through the projection part 53. Therefore, the protrusion part 53 locks the front-end part 85 and thereby prevents the earphone driver 80 from coming off (i.e., from being disengaged).

The driver cable 83 connected to the actuator extends from the base part 86. The driver cable 83 is provided to supply electric power and a measurement signal to the actuator. The driver cable 83 is bundled with the cable 93 and led to the outside of the ear canal.

In the vertical arrangement, the sound output surface (the end surface of the front-end part 85 on the +Z side) and the sound pickup part 92 of the microphone element 91 are arranged so that they face each other. Therefore, the microphone element 91 can pick up sounds output from the earphone driver 80 more appropriately. Note that although the mounting direction of the microphone elements 91 in the horizontal arrangement differs from that in the vertical arrangement, there is no significant auditory difference between the horizontal and vertical arrangements. Further, there is also no significant difference between ear-canal transfer characteristics measured in the vertical arrangement and those measured in the horizontal arrangement. In particular, they exhibit substantially the same characteristics in the low frequency band.

Further, when out-of-head localization listening is performed without performing measurements, the earphone driver 80 is attached to the ear chip in which no microphone element 91 is disposed. The earphone driver 80 is attached to an ear chip having an ordinary shape such as an ear chip having a hollow artillery-shell shape. For example, the earphone driver 80 is attached to an ear chip that includes neither the holding part 66 nor the contact part 52, but includes the cylindrical part 51 and the contact part 52. Further, by having the out-of-head localization device 100 shown in FIG. 1 perform an out-of-head localization process, a sound image can be localized outside the head. It is preferable that the ear chip used for the out-of-head localization listening include a cylindrical part 51 and a contact part 52 having shapes similar to the shapes of those of the ear chip 50 or 50A used for the measurements of individual characteristics.

[Closing of Opening 55]

Note that in the case where airtightness of the sound path is weakened owing to the opening 55 through which the cable 93 passes, it is preferable to close the opening 55. In such a case, it is preferable to close the opening 55 with the contact part 52. It is preferable to adopt a structure in which the contact part 52 is pressed against the opening 55 by folding back the contact part 52.

Figure 16:
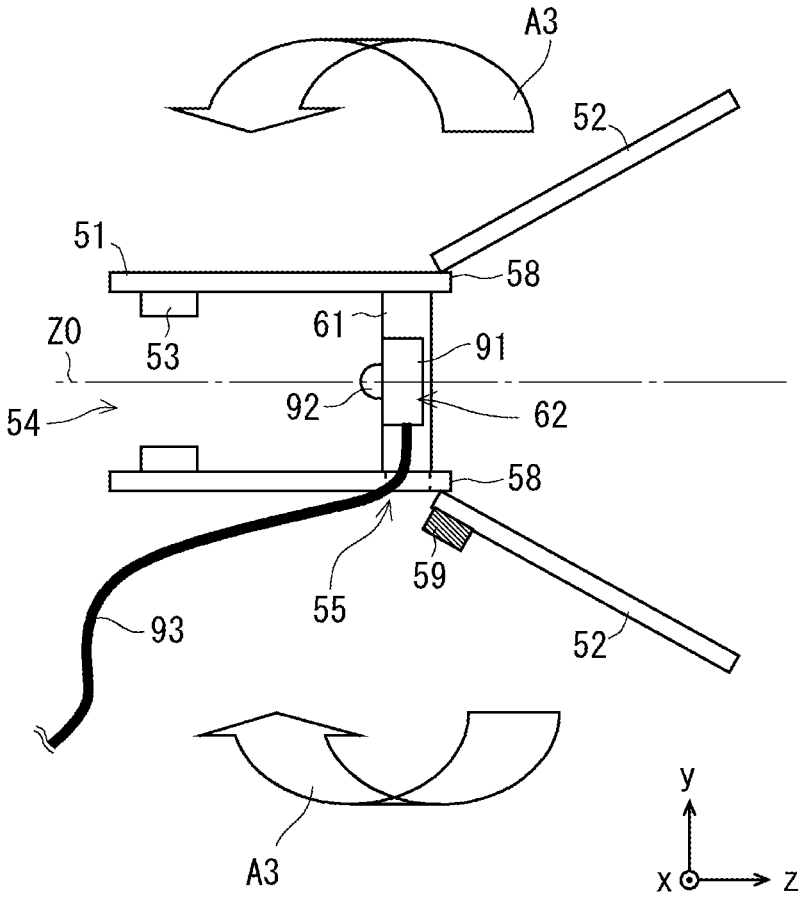
FIG. 16 shows a structure in which an opening is closed by a closing part in a vertical arrangement.
Figure 17:
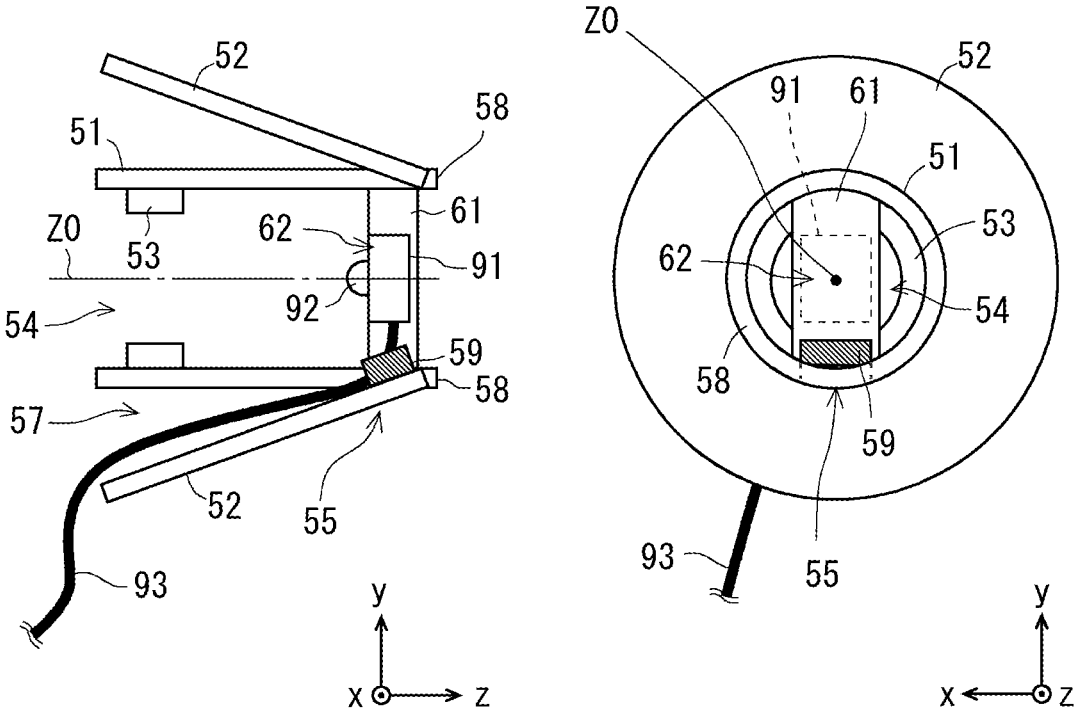
FIG. 17 shows a structure in which an opening is closed by a closing part in a vertical arrangement.

Further, it is possible to provide a closing part for closing at least a part of the opening 55 in order to enhance the airtightness. Each of FIGS. 16 and 17 shows a structure of a closing part that closes the opening 55 in a vertical arrangement. FIG. 16 is a cross-sectional side view showing an ear chip in an inside-out state and FIG. 17 shows the ear chip in a folded-back state. In FIG. 17, a left part shows a ZY-cross section and a right part shows an XY-plane view as viewed from the eardrum side of the ear canal (they also apply to FIGS. 19, 22 and 25 described below). As shown in FIG. 17, a closing part 59 is provided in a place corresponding to the opening 55 in the contact part 52. The closing part 59 functions as a lid or a cover that covers at least a part of the opening 55.

The closing part 59 is integrally formed with the contact part 52 and the like as a part of the ear chip 50. The closing part 59 is made of a silicone resin. The closing part 59 is a block that is formed near the connecting part 58 of the contact part 52. As explained in FIG. 4, the structure shown in FIG. 16 can be obtained by attaching the microphone element 91 to the column part 61 through the opening 55. Then, by folding back the contact part 52 in a direction indicated by arrows A3 in FIG. 16, the closing part 59 is fitted into the opening 55 as shown in FIG. 17.

In this way, at least a part of the opening 55 can be closed, thus making it possible to pick up sounds while maintaining the high airtightness of the hollow part 54 that acts as the sound path. Note that in the XY-plane view in FIG. 17, the closing part 59 protrudes into the hollow part 54. However, the closing part does not need to protrude into the hollow part 54.

Figure 18:
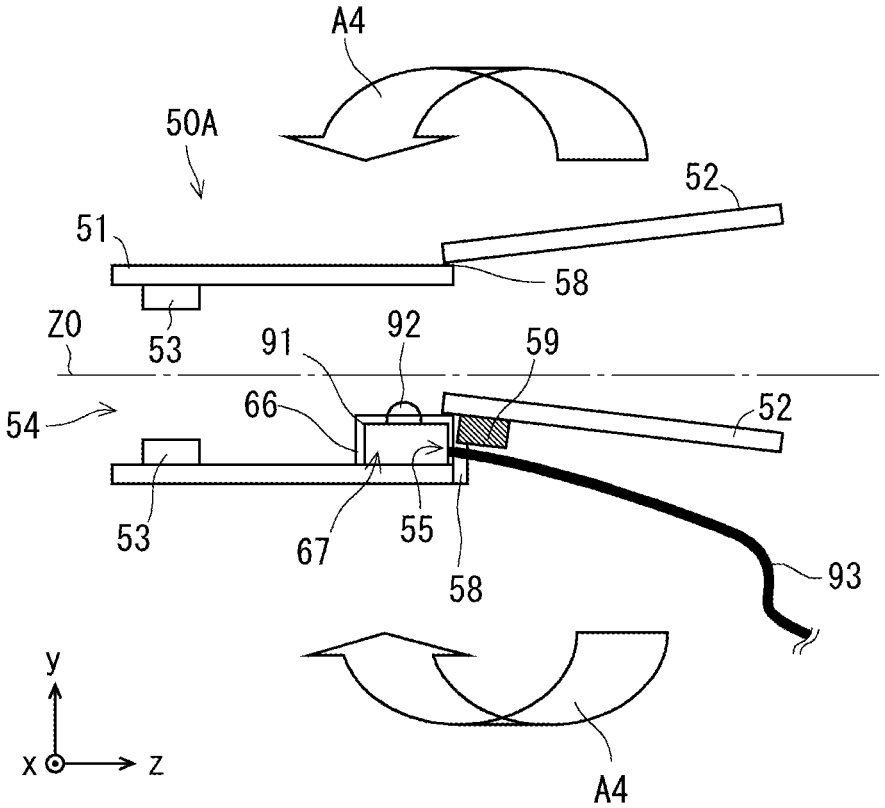
FIG. 18 shows a structure in which an opening is closed by a closing part in a horizontal arrangement.
Figure 19:
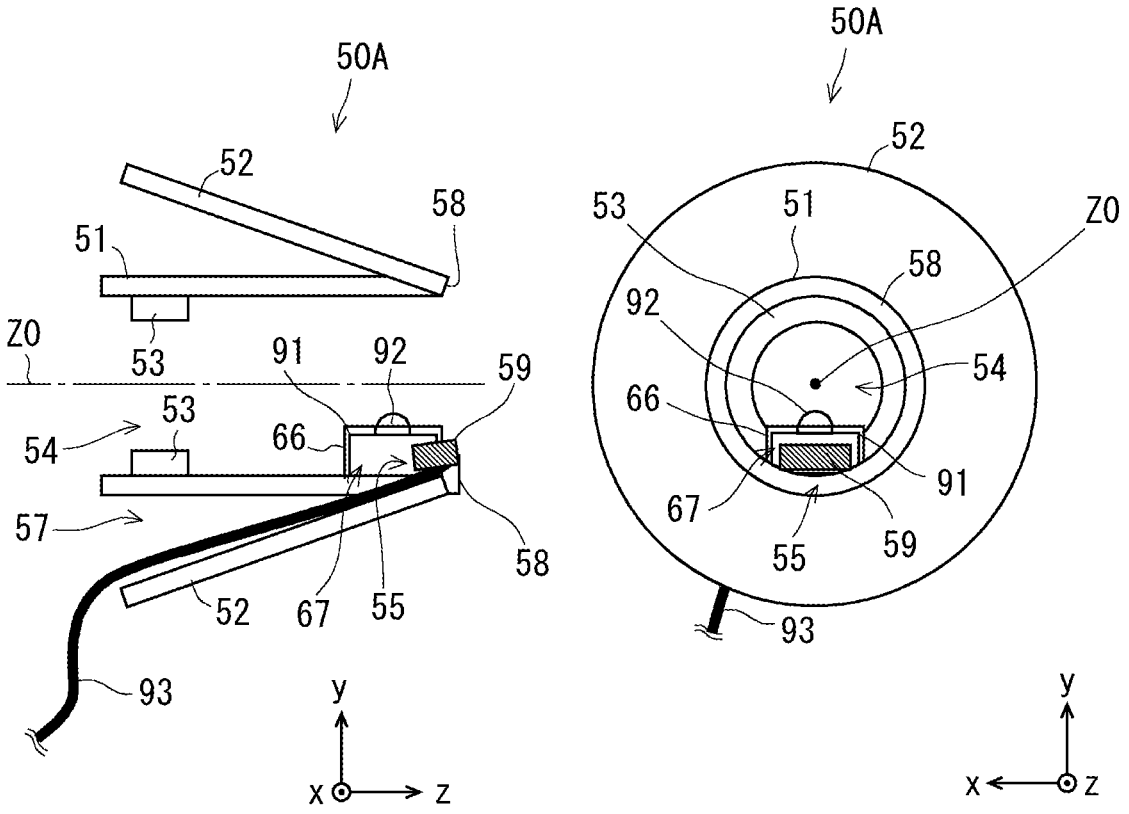
FIG. 19 shows a structure in which an opening is closed by a closing part in a horizontal arrangement.

Each of FIGS. 18 and 19 shows a structure of a horizontal arrangement in which the closing part 59 is provided. In the horizontal arrangement, the closing part 59 is also provided in a place corresponds to the opening 55 of the contact part 52. The closing part 59 is integrally formed with the contact part 52 and the like as a part of the ear chip 50A. Therefore, the closing part 59 is made of a silicone resin.

As explained in FIG. 6, the structure shown in FIG. 18 can be obtained by attaching the microphone element 91 to the holding part 66 through the opening 55. When the microphone element 91 is attached to the holding part 66, the contact part 52 is turned inside out in advance to a position where the closing part 59 does not interfere with the microphone element 91. Then, by folding back the contact part 52 in a direction indicated by arrows A4 in FIG. 18, the closing part 59 is fitted into the opening 55 as shown in FIG. 19. In this way, a part of the opening 55 can be closed and hence airtightness of the hollow part 54, which serves as the sound path, can be improved. Note that the closing part 59 does not necessarily have to completely close the opening 55. That is, the closing part 59 may close a part of the opening 55.

In this way, the opening 55 is covered by the closing part 59, thus making it possible to pick up sounds while maintaining the high airtightness of the hollow part 54 that acts as the sound path. Note that the closing part 59 does not necessarily have to be formed in the contact part 52. For example, the closing part 59 may be formed on the outer circumferential surface of the cylindrical part 51 or the connecting part 58.

Figure 20:
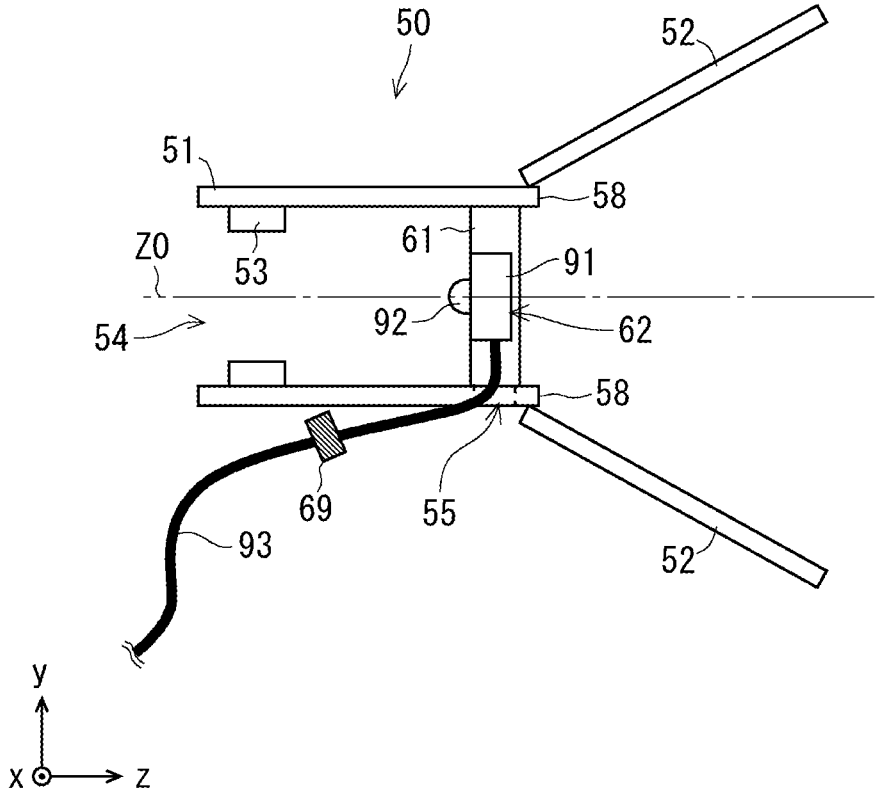
FIG. 20 shows a structure in which an opening is closed by a closing part attached to a cable in a vertical arrangement.
Figure 21:
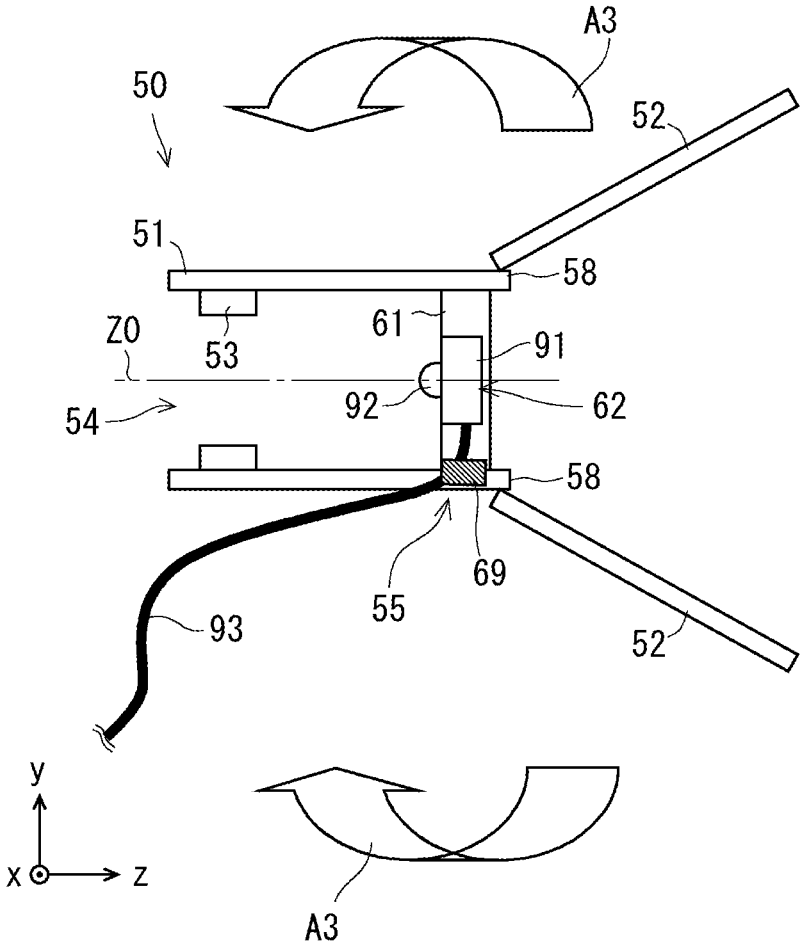
FIG. 21 shows a structure in which an opening is closed by a closing part attached to a cable in a vertical arrangement.
Figure 22:
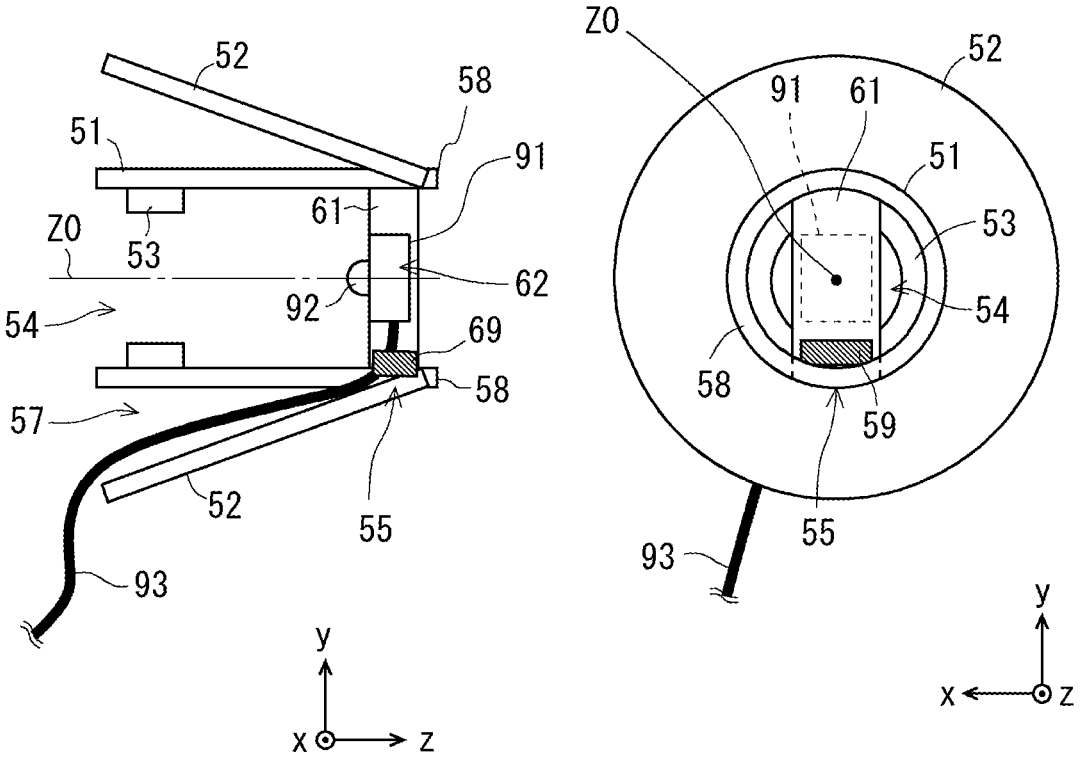
FIG. 22 shows a structure in which an opening is closed by a closing part attached to a cable in a vertical arrangement.

Further, it is possible to use a closing part that is formed separately from the ear chip 50 or 50A. A structure of a closing part that is formed separately from the ear chip 50 in the vertical arrangement is described hereinafter with reference to FIGS. 20, 21 and 22. As shown in FIGS. 20, 21 and 22, a closing part 69 is a block attached to the cable 93. A through hole through which the cable 93 is passed is formed in the closing part 69 and the cable 93 passes through the closing part 69. The closing part 69 slides along the cable 93. The closing part 69 is made of a silicone resin.

As explained in FIG. 4, by attaching the microphone element 91 to the column part 61, a structure shown in FIG. 20 is obtained. In this state, by sliding the closing part 69 to the position of the opening 55, a structure shown in FIG. 21 is obtained. The closing part 69 is fitted into the opening 55 and the opening 55 is thereby closed by the closing part 69. Then, by turning the contact part 52 inside out in a direction indicated by arrows A3 in FIG. 21, a structure shown in FIG. 22 is obtained. In this way, the opening 55 is covered, thus making it possible to pick up sounds while maintaining the high airtightness of the hollow part 54 that serves as the sound path.

Figure 23:
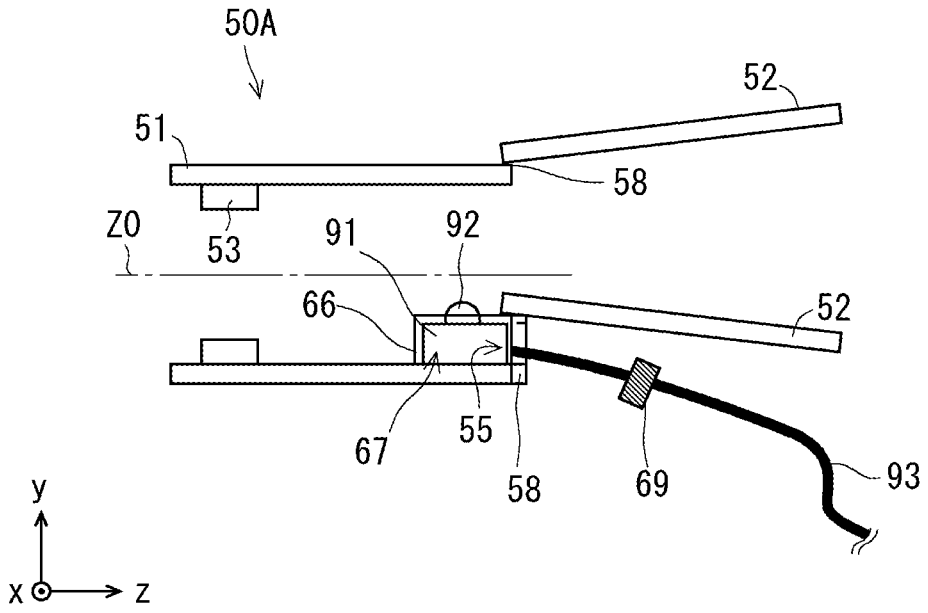
FIG. 23 shows a structure in which an opening is closed by a closing part attached to a cable in a horizontal arrangement.
Figure 24:
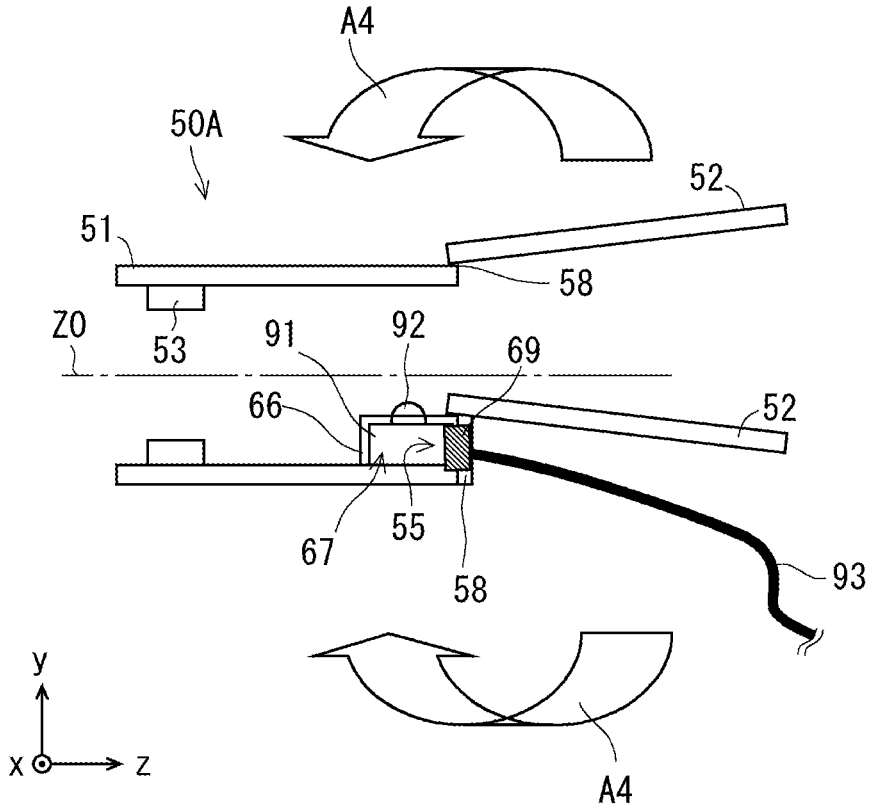
FIG. 24 shows a structure in which an opening is closed by a closing part attached to a cable in a horizontal arrangement.
Figure 25:
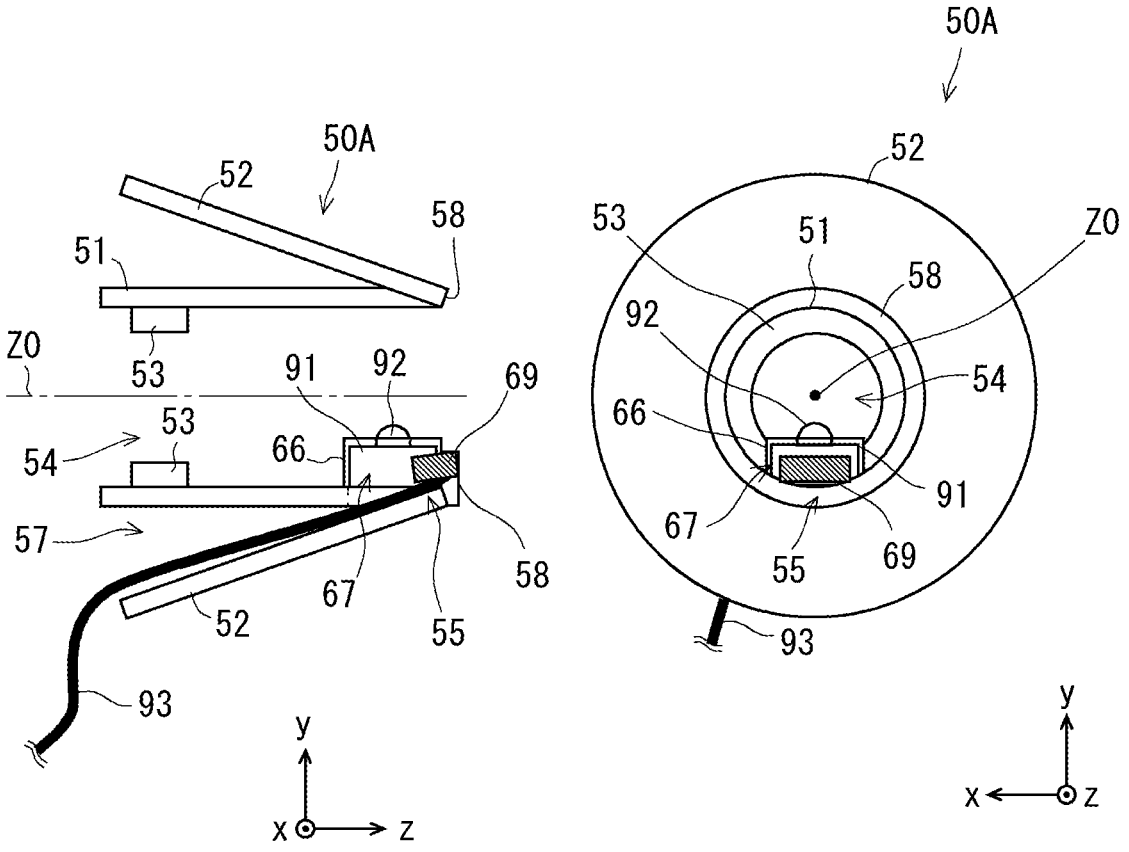
FIG. 25 shows a structure in which an opening is closed by a closing part attached to a cable in a horizontal arrangement.

A structure of a closing part that is formed separately from the ear chip 50A in the horizontal arrangement is described with reference to FIGS. 23, 24 and 25. As shown in FIGS. 23, 24 and 25, the cable 93 is attached to the closing part 69. That is, the cable 93 passes through the closing part 69. The closing part 69 slides along the cable 93. The closing part 69 is made of a silicone resin.

As described above with reference to FIG. 6, by attaching the microphone element 91 to the holding part 66, a structure shown in FIG. 23 is obtained. In this state, the closing part 69 is slid toward the opening 55. Further, by closing the opening 55 with the closing part 69, a structure shown in FIG. 24 is obtained. Then, by turning the contact part 52 inside out in a direction indicated by arrows A4 in FIG. 24, a structure shown in FIG. 25 is obtained.

As described above, by using the closing part 69 that is slidably provided in the cable 93, the opening 55 can be closed. In this way, it becomes possible to pick up sounds while maintaining the high airtightness. Note that the closing part 69 does not necessarily have to completely close the opening 55. That is, the closing part 69 may close a part of the opening 55. Further, the closing part 69 is not limited to those having the structure in which the closing part 69 is fitted into the opening 55. That is, the closing part 69 may have a structure in which the opening 55 is covered in the outside of the cylindrical part 51.

Figure 26:
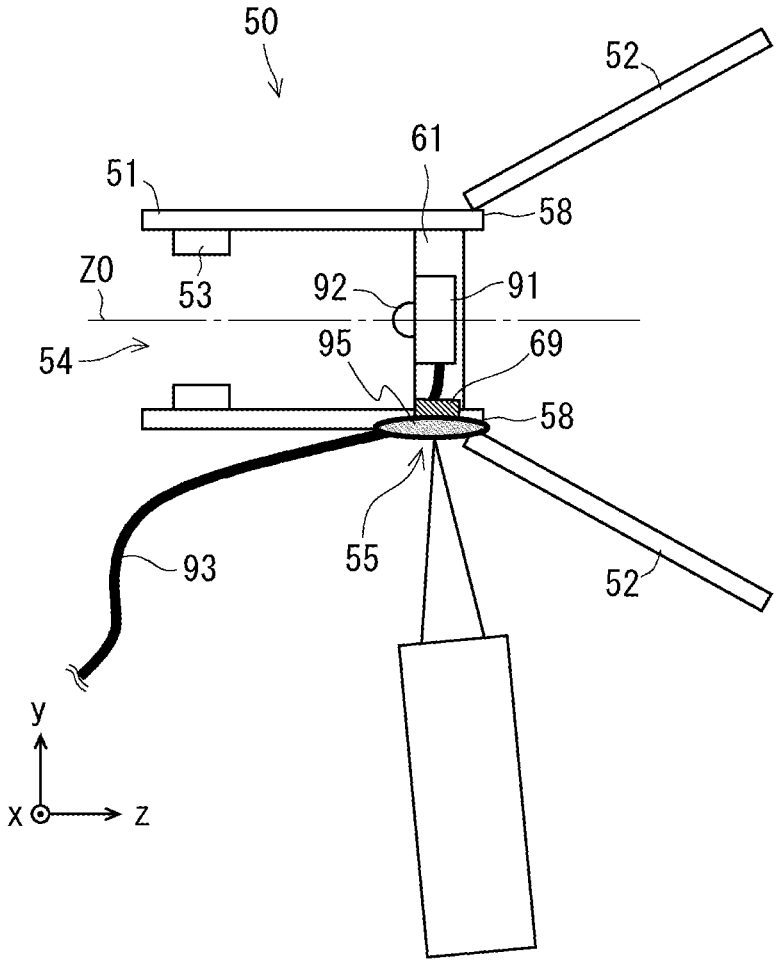
FIG. 26 shows a structure in which an opening 55 is closed by an adhesive in a vertical arrangement.
Figure 27:
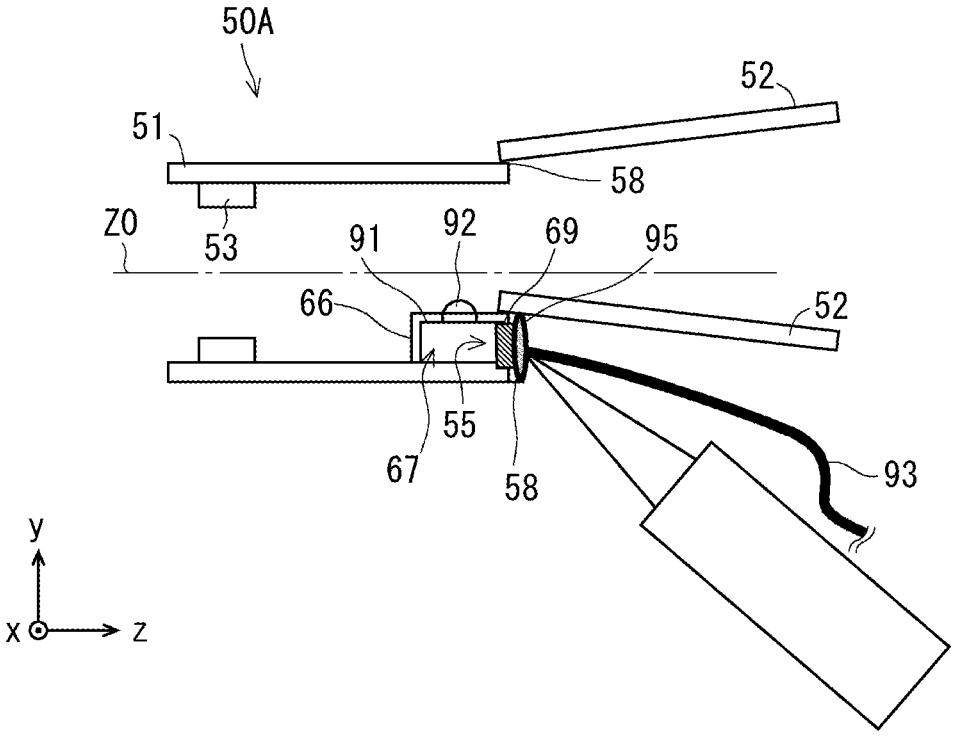
FIG. 27 shows a structure in which an opening 55 is closed by an adhesive in a horizontal arrangement.

Further, in the case where the microphone element 91 is not detached from the ear chip after it is attached thereto, it is possible to enhance the airtightness by using an adhesive. For example, as shown in FIGS. 26 and 27, the contact part 52 is brought into the inside-out state. Then, paste of an adhesive 95 is applied to the peripheries of the opening 55 and the closing part 69. Then, the adhesive 95 is dried, so that they are firmly fixed in the periphery of the opening 55. In this way, the opening 55 can be closed, thus making it possible to pick up sounds while maintaining the high airtightness.

Note that in FIGS. 26 and 27, the adhesive 95 is used in the vertical arrangement and the horizontal arrangement in which the closing part 69 is used. However, the opening 55 may be closed by using only the adhesive 95, i.e., without using the closing part 69.

Second Embodiment

In a second embodiment, the structure of the ear chip differs from that of the first embodiment. Specifically, in the first embodiment, each of the ear chips 50 and 50A is integrally formed of a silicone resin. In contrast to this, in the second embodiment, the ear chip is formed by using two or more resin-molded articles. In the second embodiment, an ear chip in the vertical arrangement is referred to as an ear chip 50B and an ear chip in the horizontal arrangement is referred to as an ear chip 50C. Note that descriptions of components/structures similar to those in the first embodiment are omitted as appropriate.

(Structure in Vertical Arrangement)

Figure 28:
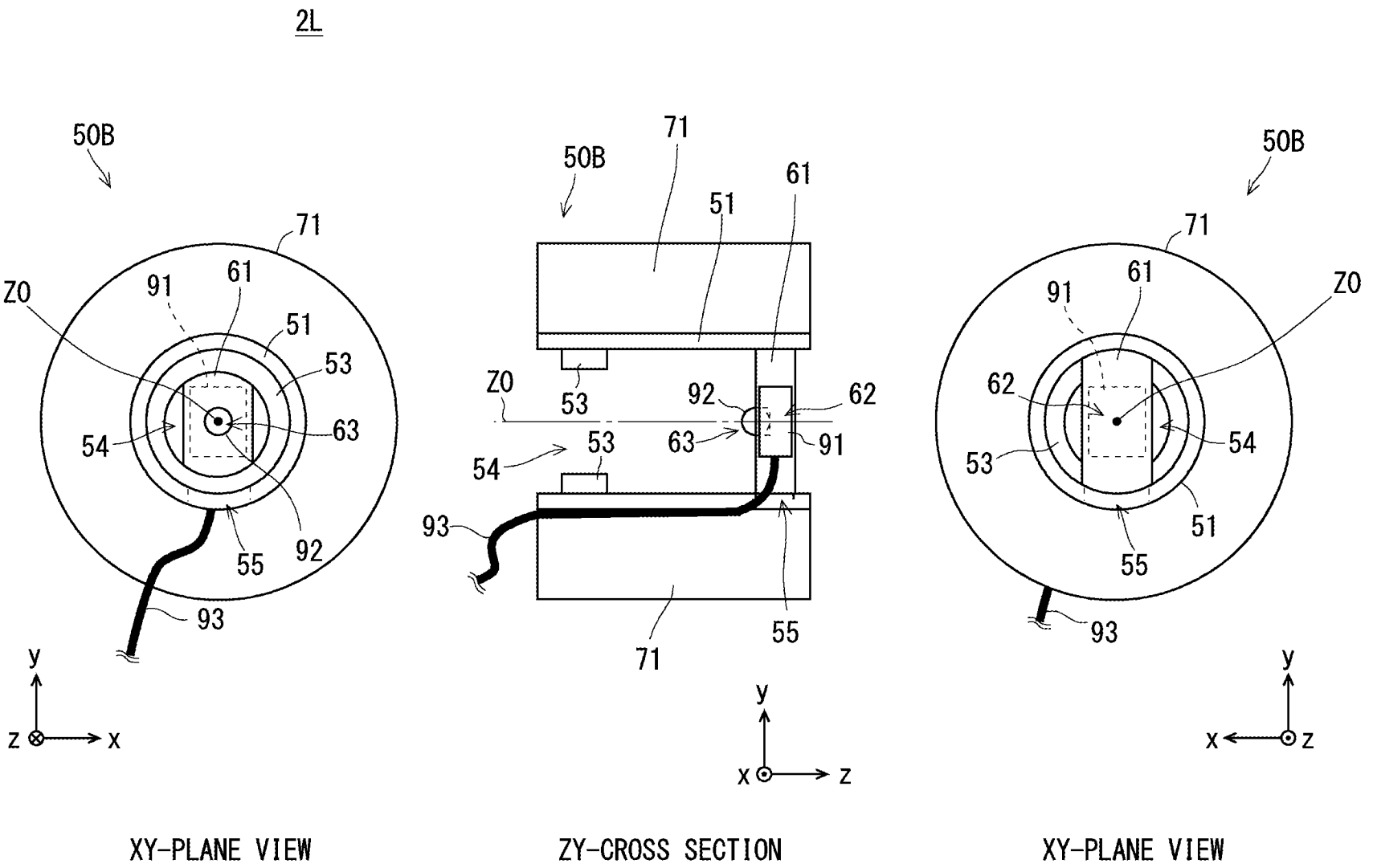
FIG. 28 shows a structure in which a microphone element is attached in a vertical arrangement in microphone according to a second embodiment.

FIG. 28 shows the ear chip 50B in the vertical arrangement. A contact part 71 of the ear chip 50B differs from the contact part 52 of the ear chip 50 described in the first embodiment. That is, the contact part 71 is provided in place of the contact part 52 and the connecting part 58 is not provided. The cylindrical part 51 and the column part 61 have structures similar to those in the first embodiment. That is, the cylindrical part 51 and the column part 61 are integrally formed of a silicone resin or the like. Similarly to the first embodiment, the cylindrical part 51 has an opening 55, and the column part 61 has a microphone hole 63 and a housing part 62. Further, the microphone element 91 is attached to the ear chip by using a structure similar to that in the first embodiment.

In this embodiment, the contact part 71 is made of an elastic urethane resin. Further, the contact part 71 is formed in a cylindrical shape. That is, the contact part 71 is formed by using a urethane tube. The cylindrical part 51 is a resin-molded article that is formed separately from the contact part 71. The cylindrical part 51 is inserted into the contact part 71. That is, the ear chip 50B has a two-layered cylindrical structure consisting of a silicone-resin layer and a urethane-resin layer. That is, the cylindrical part 51, which is a silicone tube, is inserted into the contact part 71, which is a urethane tube. The length of the contact part 71 in the Z-direction is equal to that of the cylindrical part 51.

The ear chip 50B is press-fitted into the ear canal. That is, the ear chip 50B is fixed in the ear canal by the elastic force of the contact part 71, which is formed of a urethane resin. The cable 93 passes through an inter-layer space between the contact part 71 and the cylindrical part 51 and is led to the outside of the ear canal. For example, the contact part 71 and the cylindrical part 51 may be bonded together by an adhesive.

Figure 29:
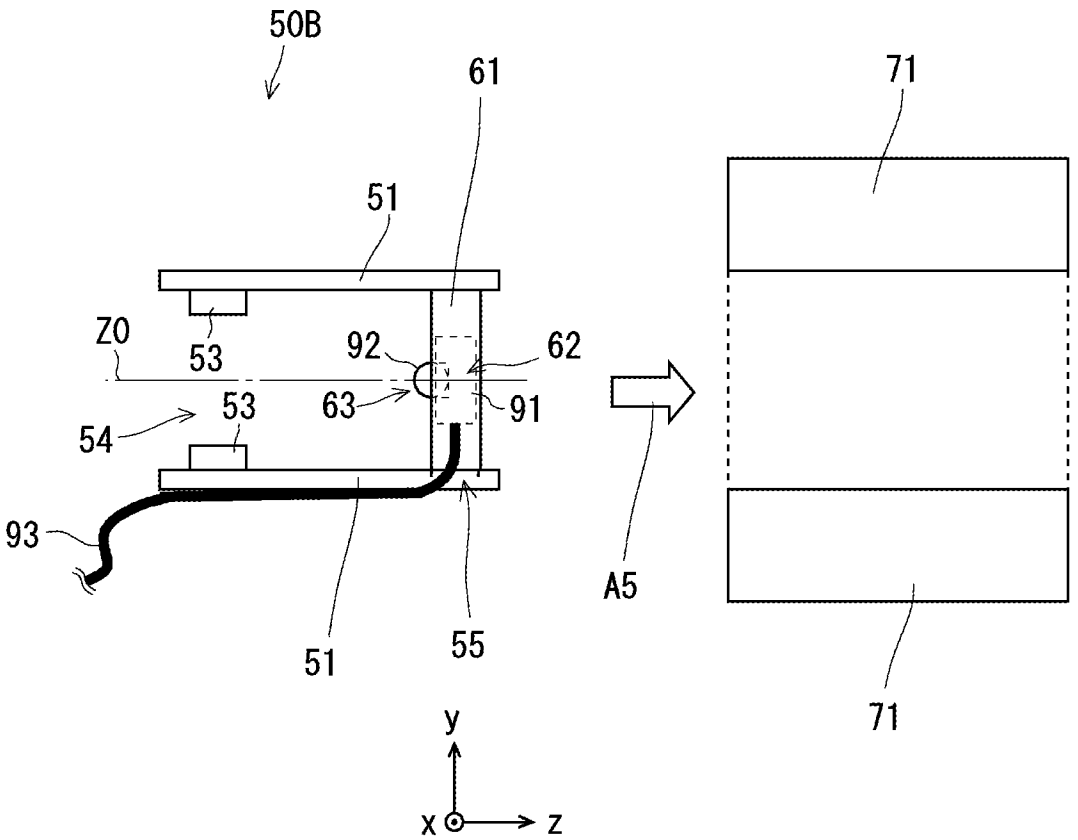
FIG. 29 shows a structure in which a microphone element is attached in a vertical arrangement in microphone according to the second embodiment.

FIG. 29 shows a state in which the microphone element 91 is attached in a vertical arrangement. Similarly to the first embodiment shown in FIG. 4, the microphone element 91 is inserted through the opening 55 and is housed in the housing part 62. Note that the cable 93 is led to the outside of the cylindrical part 51 through the opening 55. Then, the cylindrical part 51 is inserted into the contact part 71 (indicated by an arrow A5). By fitting the cylindrical part 51 into the contact part 71, a microphone 2L is completed. Note that the cylindrical part 51 and the contact part 71 may be bonded together by applying an adhesive to the outer circumferential surface of the cylindrical part 51 or the inner circumferential surface of the contact part 71.

(Structure in Horizontal Arrangement)

Figure 30:
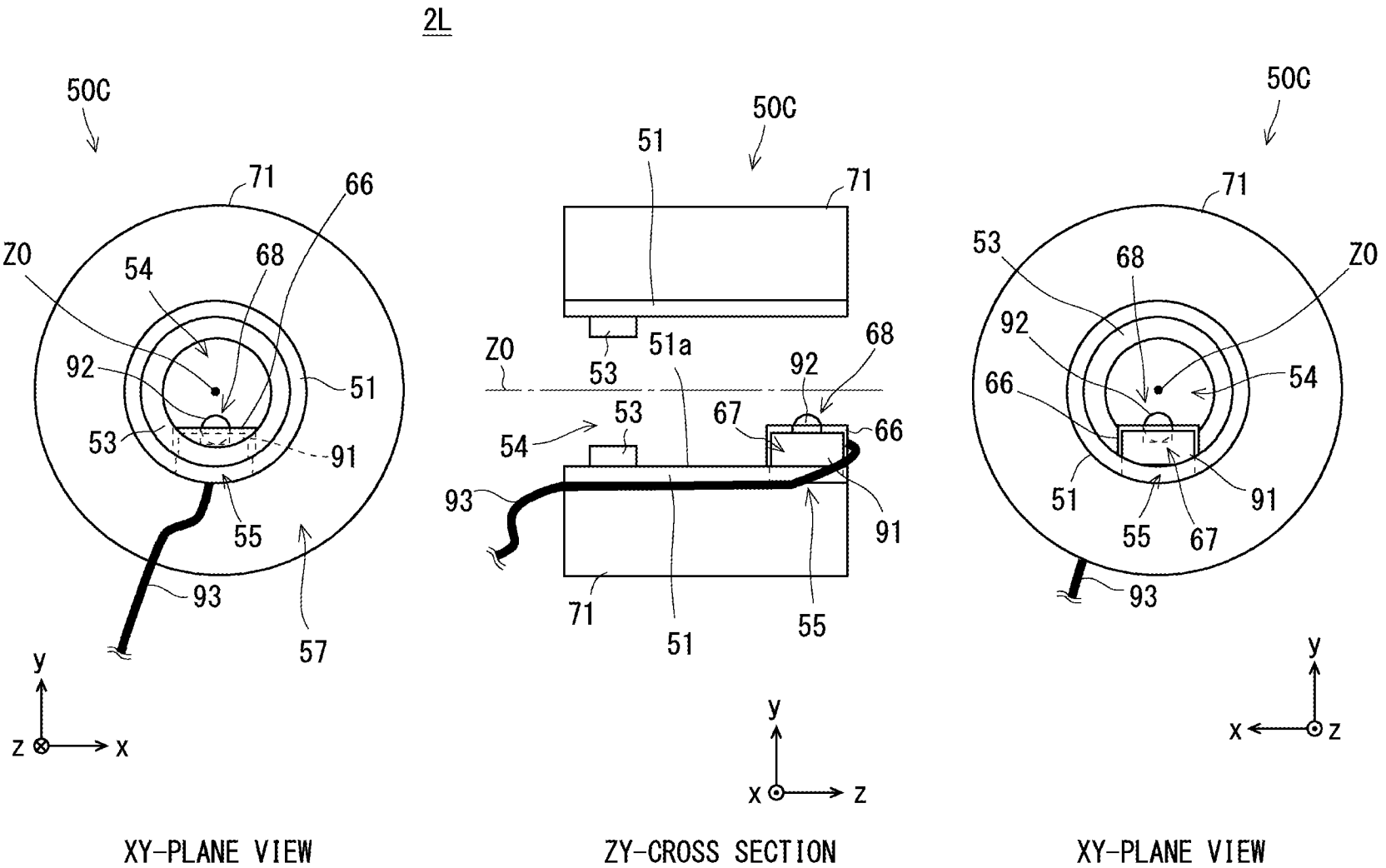
FIG. 30 shows a structure in which a microphone element is attached in a horizontal arrangement in microphone according to the second embodiment.

Next, an ear chip 50C in the horizontal arrangement is described with reference to FIG. 30. A contact part 71 is provided in place of the contact part 52 of the ear chip 50A and the connecting part 58 is not provided. Similarly to the ear chip 50B in the vertical arrangement, a contact part 71 is formed of an elastic urethane resin in the ear chip 50C. Similarly to the contact part 71 of the ear chip 50B, the contact part 71 is formed by using a cylindrical urethane tube. The cylindrical part 51 is inserted into the contact part 71.

The cylindrical part 51 and the holding part 66 have structures similar to those in the first embodiment. That is, the cylindrical part 51 and the holding part 66 are integrally formed of a silicone resin or the like. Similarly to the first embodiment, the cylindrical part 51 has an opening 55, and the holding part 66 has a microphone hole 68 and a housing part 67. Further, the microphone element 91 is attached to the ear chip by using a structure similar to that in the first embodiment.

Figure 31:
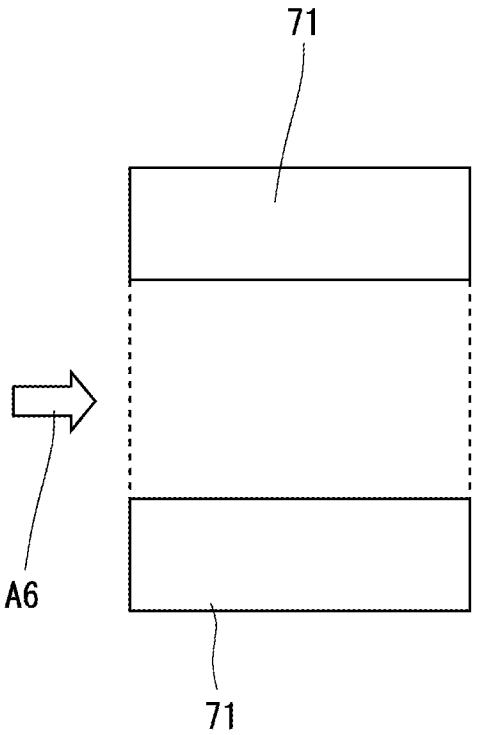
FIG. 31 shows a structure in which a microphone element is attached in a horizontal arrangement in microphone according to the second embodiment.
Figure 31:
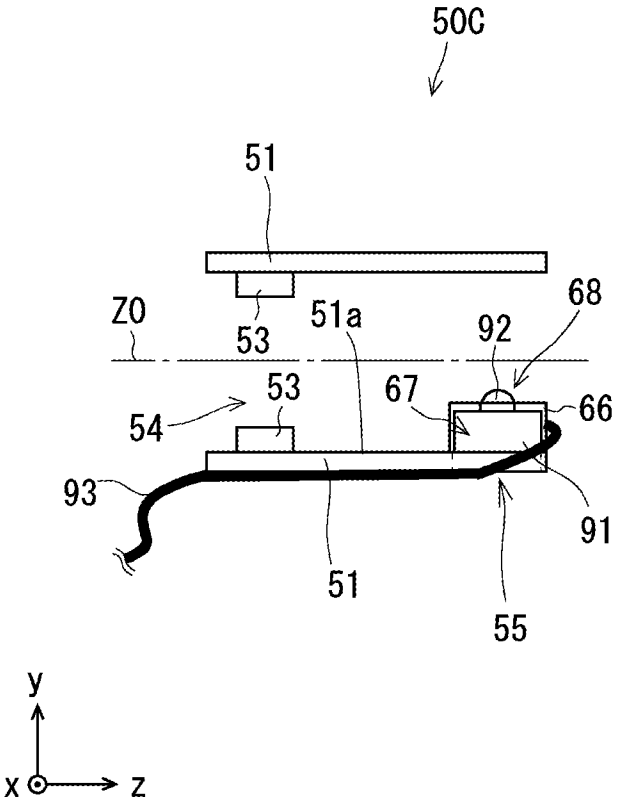

FIG. 31 shows a state in which the microphone element 91 is attached in a horizontal arrangement. Similarly to the first embodiment shown in FIG. 6, the microphone element 91 is inserted through the opening 55 and is housed in the housing part 62. Note that the cable 93 is led to the outside of the cylindrical part 51 through the opening 55. Then, the cylindrical part 51 is inserted into the contact part 71 (indicated by an arrow A6). By fitting the cylindrical part 51 into the contact part 71, a microphone 2L is completed. Note that the cylindrical part 51 and the contact part 71 may be bonded together by applying an adhesive to the outer circumferential surface of the cylindrical part 51 or the inner circumferential surface of the contact part 71.

Advantageous effects similar to those achieved in the first embodiment can also be achieved by the vertical arrangement or the horizontal arrangement described in the second embodiment. Since the cable 93 passes between the contact part 71 and the cylindrical part 51, it is possible to reduce the influence of the wiring of the cable 93 and thereby to appropriately pick up sounds. Further, it is possible to select the ear chip 50B or 50C according to the size of the ear canal of the measurement subject 1 and carry out measurements with the selected ear chip. Therefore, it is possible to measure individual characteristics in a state where the microphone element 91 is disposed in an appropriate place.

Modified Example 1

Figure 32:
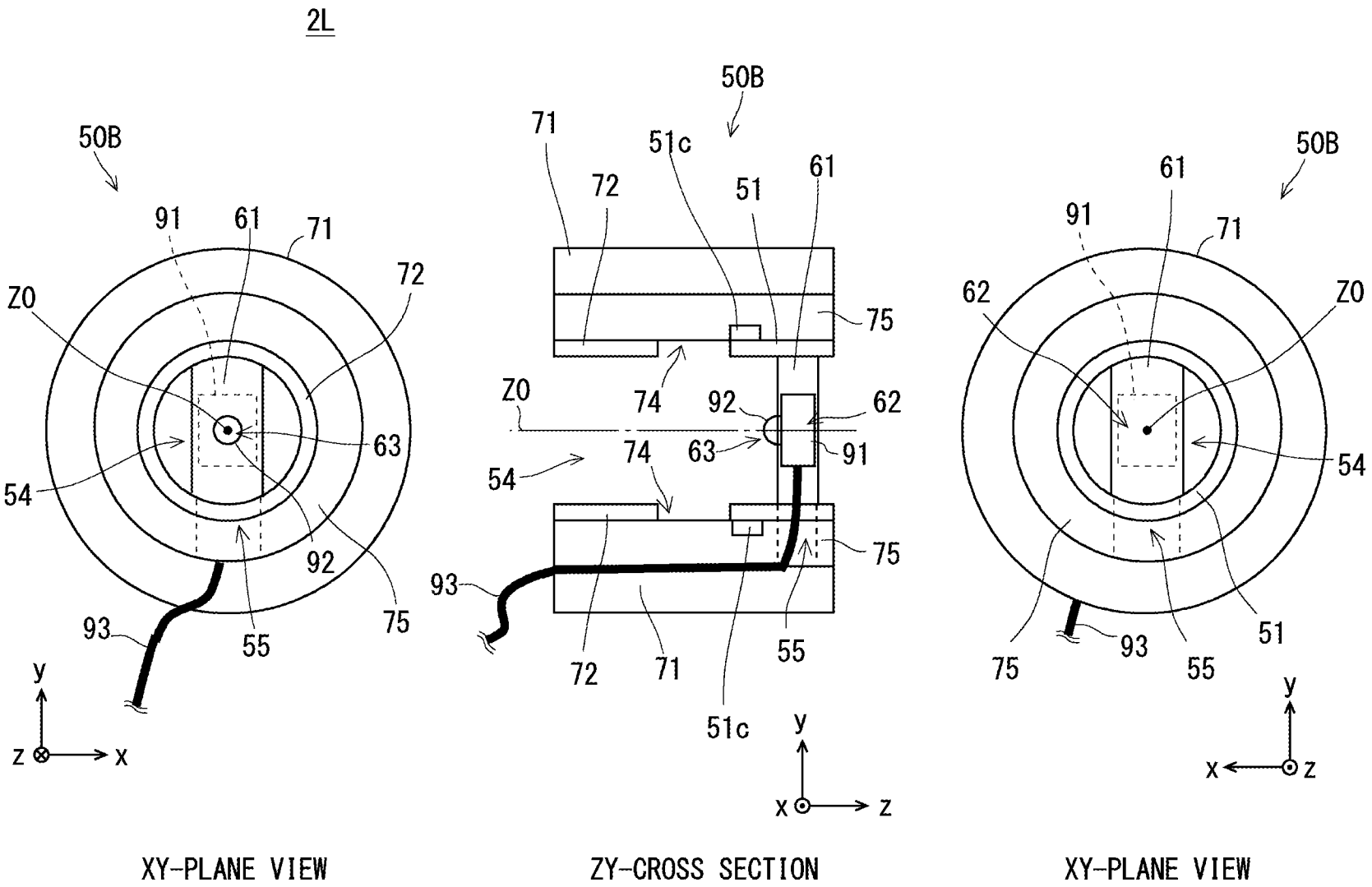
FIG. 32 shows a structure a microphone according to a modified example 1.

A modified example 1 is described with reference to FIG. 32. FIG. 32 shows a structure of a microphone 2L according to the modified example 1. FIG. 32 shows a structure of an ear chip 50B in a vertical arrangement according to a modified example. Structures of the cylindrical part 51 and the like are basically similar to those in the first and second embodiments, and hence explanations of them will be omitted as appropriate.

In the modified example 1, the length of the contact part 71 in the Z-direction differs from that of the cylindrical part 51. Specifically, the cylindrical part 51 is shorter than the contact part 71 in the Z-direction. The position of the end face of the cylindrical part 51 on the +Z side coincides with that of the contact part 71. Further, a protrusion 51*c* is provided on the outer circumferential surface of the cylindrical part 51. The protrusion 51*c* is engaged with a recessed part of the contact part 71. In this way, the cylindrical part 51 and the contact part 71 are fixed together.

Further, an outer cylindrical part 72 is provided on the −Z side of the cylindrical part 51. The outer cylindrical part 72 has a cylindrical shape with an outer diameter equal to that of the cylindrical part 51. The outer cylindrical part 72 is a silicone tube or a vinyl tube. The position of the end face of the outer cylindrical part 72 on the −Z side coincides with that of the contact part 71.

The outer cylindrical part 72 is disposed with a clearance from the cylindrical part 51 in the Z-direction. Therefore, a recessed part 74 that is recessed outward in the radial direction is formed between the outer cylindrical part 72 and the cylindrical part 51. The front-end part 85 of the earphone driver 80 is disposed and thereby locked in this recessed part 74. The projection part 53 is not provided to the outer cylindrical part 72.

An intermediate layer 75 is provided between the contact part 71 and the cylindrical part 51. The intermediate layer 75 is a urethane tube that is formed separately from the contact part 71. Therefore, a two-layered structure consisting of two urethane tubes are formed on the outer side of the cylindrical part 51. That is, the intermediate layer 75 is the urethane tube in the inner layer and the contact part 71 is the urethane tube in the outer layer. The intermediate layer 75 has a length equal to that of the contact part 71 in the Z-direction. Therefore, the intermediate layer 75 is also disposed on the outer side of the outer cylindrical part 72.

Further, the cable 93 passes through an inter-layer space between the contact part 71 and the intermediate layer 75 and is led to the outside of the ear chip. In this case, the opening 55 is also in the intermediate layer 75 as well as in the cylindrical part 51. In other words, the microphone element 91 is attached to the ear chip after attaching the intermediate layer 75 to the cylindrical part 51 and before attaching the contact part 71 to the cylindrical part 51. That is, the microphone element 91 is inserted from the outside of the intermediate layer 75 into the housing part 62 through the opening 55.

Advantageous effects similar to those described above can also be achieved by the above-described structure. Note that although the structure in the vertical arrangement is shown in FIG. 32, the structure of the modified example 1 can also be applied to structures in the horizontal arrangement. For example, the intermediate layer 75 may be provided between the cylindrical part 51 and the contact part 71 in the horizontal arrangement. Alternatively, the outer cylindrical part 72 may be disposed on the −Z side of the cylindrical part 51 in the horizontal arrangement.

Modified Example 2

Figure 33:
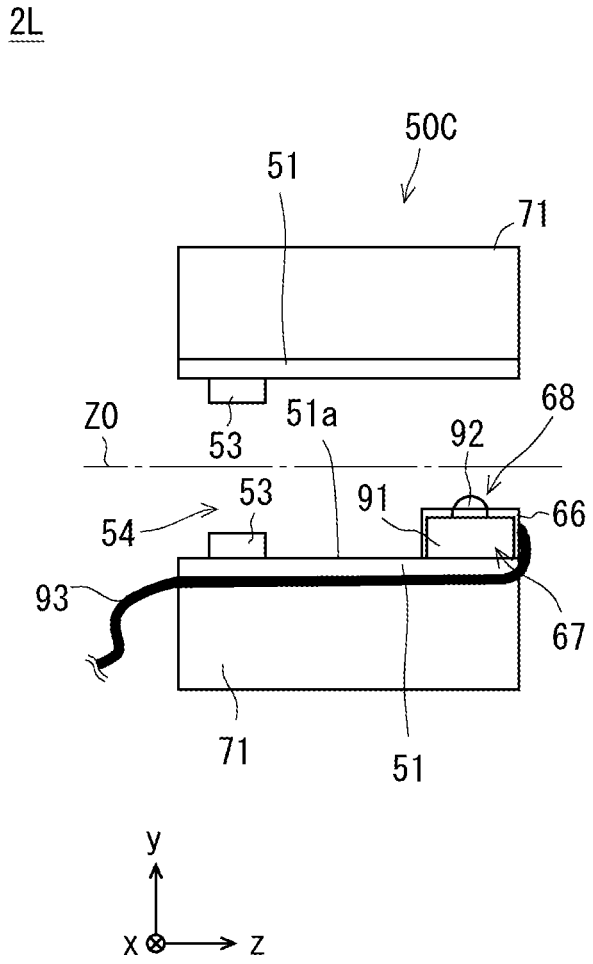
FIG. 33 shows a structure a microphone according to a modified example 2.

In a modified example 2, a structure for leading out the cable 93 differs from those in the embodiments and the modified example 1. A structure of a microphone 2L according to the modified example 2 of the second embodiment is described with reference to FIG. 33. In FIG. 33, the opening 55 is provided in neither the cylindrical part 51 nor the intermediate layer 75.

The cable 93, which is led out from the microphone element 91, passes through a space on the +Z side of the end face of the cylindrical part 51 on the +Z side and wired to an inter-layer space between the cylindrical part 51 and the contact part 71. Then, the cable 93 passes through the inter-layer space between the cylindrical part 51 and the contact part 71, and is led to the outside of the ear chip. Advantageous effects similar to those described above can also be achieved by the above-described structure. Note that although the structure in the horizontal arrangement is shown in FIG. 33, the structure of the modified example 2 can also be applied to structures in the vertical arrangement. Further, in the structure according to the modified example 2, the intermediate layer 75 may be provided between the cylindrical part 51 and the contact part 71, so that the cable 93 passes through an inter-layer space between the intermediate layer 75 and the contact part 71.

In the ear chips 50, 50A, 51B or 50C illustrated in Figs, the inter diameter and the outer diameter of the cylindrical part 51 are substantially constant, however the inter diameter and the outer diameter of the cylindrical part 51 can vary according to Z position. For example, the cylindrical part 51 has a hollow taper tube shape, a hollow artillery-shell shape or the like. Further, the inner peripheral surface and the outer circumferential surface of the cylindrical part 51 have a circle shape in the XY plane, but those can have shapes other than circle. For example, the inner peripheral surface and the outer circumferential surface of the cylindrical part 51 have an ellipse shape, a polygonal shape or the like in the XY plane. As described above, the shape of the cylindrical part 51 is not limited to the perfect circle cylinder.

In the ear chips 51B or 50C illustrated in Figs, the inter diameter and the outer diameter of the contact part 71 are substantially constant, however the inter diameter and the outer diameter of the contact part 71 can vary according to Z position. For example, the contact part 71 has a hollow taper tube shape, a hollow artillery-shell shape or the like. Further, the inner peripheral surface and the outer circumferential surface of the contact part 71 have a circle shape in the XY plane, but those can have shapes other than circle. For example, the inner peripheral surface and the outer circumferential surface of the contact part 71 have an ellipse shape, a polygonal shape or the like in the XY plane. As described above, the shape of the contact part 71 is not limited to the perfect circle cylinder.

[Sound Pickup Method]

A sound pickup method using microphones 2L and 2R each having the structure described in the first and second embodiments is explained. In order to measure ear-canal transfer characteristics, a measurement subject 1 wears the microphones 2L and 2R in which the earphone drivers 80 are not attached. Then, as shown in FIG. 2, sounds output from speakers 5L and 5R, which are external sound sources, are picked up by the microphone elements 91. In this way, impulse response measurements are carried out and hence spatial acoustic transfer characteristics can be acquired.

Next, the measurement subject 1 wears the sound pickup device 4 in which the earphone drivers 80 are attached to the microphones 2L and 2R. Then, sounds output from the earphone drivers 80, which are sound sources, are picked up by the microphone elements 91. In this way, impulse response measurements are carried out and hence ear-canal transfer characteristics can be acquired. Note that the order of the measurements of spatial acoustic transfer characteristics and ear-canal transfer characteristics can be the other way around.

Since individual characteristics can be appropriately measured by using the above-described microphones 2L and 2R, the filter generation device 200 can generate appropriate filters. Further, out-of-head localization listening can be carried out by having a user wear ear chips for listening in which the earphone drivers 80 are attached. As the ear chips for listening, those having ordinary shapes in which the column part 61 and the holding part 66 are not provided can be used. An out-of-head localization process can be carried out by using a filter corresponding to the result of the individual measurement.

A program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g. magneto-optical disks), CD-ROM (compact disc read only memory), CD-R (compact disc recordable), CD-R/W (compact disc rewritable), and semiconductor memories (such as mask ROM, PROM (programmable ROM), EPROM (erasable PROM), flash ROM, RAM (random access memory), etc.). The program may be provided to a computer using any type of transitory computer readable media. Examples of transitory computer readable media include electric signals, optical signals, and electromagnetic waves. Transitory computer readable media can provide the program to a computer via a wired communication line (e.g. electric wires, and optical fibers) or a wireless communication line.

The first and second embodiments can be combined as desirable by one of ordinary skill in the art.

The present disclosure made by the inventors of the present application has been explained above in a concrete manner based on embodiments. However, the present disclosure is not limited to the above-described embodiments, and needless to say, various modifications can be made without departing from the spirit and scope of the present disclosure.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

What is claimed is:

1. A microphone comprising:

an ear chip comprising a cylindrical part with a hollow part formed therein, a contact part disposed outside the cylindrical part and configured to come into contact with an inner wall surface of an ear canal, and an opening;

a cable configured to pass through the opening; and a microphone element disposed in the hollow part and connected to the cable, wherein the contact part is formed as a flange part, the flange part being folded back while using a front-end side of the cylindrical part as a base part, and the cable passes through a gap between the contact part and the cylindrical part and is lead out to the outside of the cylindrical part.

2. The microphone according to claim 1, further comprising a column part connected to an inner circumferential surface of the cylindrical part, wherein the microphone element is attached to the column part.

3. The microphone according to claim 1, further comprising a column part arranged along a direction perpendicular to an axis of the cylindrical part, wherein both ends of the column part are connected to an inner circumferential surface of the cylindrical part, and wherein the microphone element is attached to the column part.

4. The microphone according to claim 1, wherein a holding part configured to hold the microphone element is formed on an inner circumferential surface of the cylindrical part, and the microphone element is held in the holding part.

5. The microphone according to claim 1, wherein a holding part configured to hold the microphone element is formed on an inner circumferential surface of the cylindrical part, and in an axis direction of the cylindrical part, the microphone element is held in the vicinity of one end of on an eardrum side of the cylindrical part by the holding part.

6. The microphone according to claim 1, wherein the opening is covered by the contact part in a state where the contact part is folded back.

7. The microphone according to claim 1, further comprising a closing part configured to close the opening.

8. The microphone according to claim 1, wherein a closing part is provided in the ear chip, and the closing part closes the opening in a state where the contact part is folded back.

9. A sound pickup method using the microphone according to claim 1, comprising:

picking up a sound output from an earphone driver attached to the microphone by using the microphone element; and picking up a sound output from an external sound source by using the microphone element in a state where the earphone drive is not attached to the microphone.

* * * * *